US011420780B2

(12) United States Patent
Yoshida et al.

(10) Patent No.: US 11,420,780 B2
(45) Date of Patent: Aug. 23, 2022

(54) BINDING MACHINE

(71) Applicant: MAX CO., LTD., Tokyo (JP)

(72) Inventors: Yusuke Yoshida, Tokyo (JP); Kenichi Arai, Tokyo (JP); Shigeki Shindou, Tokyo (JP)

(73) Assignee: MAX CO., LTD., Tokyo (JP)

( * ) Notice: Subject to any disclaimer, the term of this patent is extended or adjusted under 35 U.S.C. 154(b) by 113 days.

(21) Appl. No.: 16/815,648

(22) Filed: Mar. 11, 2020

(65) Prior Publication Data

US 2020/0290760 A1 Sep. 17, 2020

(30) Foreign Application Priority Data

Mar. 11, 2019 (JP) ..... JP2019-044290

(51) Int. Cl.

| | |
|---|---|
| ***B65B 13/28*** | (2006.01) |
| ***B21F 23/00*** | (2006.01) |
| ***B25B 25/00*** | (2006.01) |
| ***B65B 13/02*** | (2006.01) |
| ***E04G 21/12*** | (2006.01) |
| ***B21F 15/04*** | (2006.01) |
| ***B21F 15/06*** | (2006.01) |

(52) U.S. Cl.

CPC ..... *B65B 13/285* (2013.01); *B21F 15/04* (2013.01); *B21F 15/06* (2013.01); *B21F 23/005* (2013.01); *B25B 25/00* (2013.01); *B65B 13/025* (2013.01); *E04G 21/123* (2013.01)

(58) Field of Classification Search

CPC ..... B65B 13/28; B65B 13/025; B65B 13/285; B65B 13/04; B65B 13/06; B65B 27/10; B65B 13/185; B65B 13/184; B21F 15/04; B21F 15/06; B21F 7/00; B21F 23/005; E04G 21/123; B25B 25/00

See application file for complete search history.

(56) References Cited

U.S. PATENT DOCUMENTS

| | | | | |
|---|---|---|---|---|
| 2009/0283168 | A1* | 11/2009 | Kusakari | E04G 21/122 140/119 |
| 2016/0031575 | A1* | 2/2016 | Shindou | B65B 13/285 100/25 |
| 2018/0155940 | A1 | 6/2018 | Nagaoka et al. | |
| 2018/0187431 | A1 | 7/2018 | Itagaki et al. | |
| 2019/0292799 | A1 | 9/2019 | Itagaki et al. | |

FOREIGN PATENT DOCUMENTS

| | | | |
|---|---|---|---|
| JP | 2018-109299 | A | 7/2018 |
| WO | 2017-014280 | A1 | 1/2017 |

OTHER PUBLICATIONS

The Extended European Search Report mailed in corresponding EP Patent Application No. 20162108.3 dated Jul. 10, 2020 (8 pages).

* cited by examiner

*Primary Examiner* — Jessica Cahill

*Assistant Examiner* — Bobby Yeonjin Kim

(74) *Attorney, Agent, or Firm* — Weihrouch IP

(57) ABSTRACT

A binding machine includes a wire feeding unit configured to feed a wire to be wound on an object to be bound, a binding unit configured to twist the wire wound on the object to be bound, a curl guide configured to curl the wire being fed by the wire feeding unit, an inductive guide configured to guide the wire curled by the curl guide toward the binding unit, and a retraction guide part configured to retract the wire to a downstream side of the binding unit with respect to a feeding direction of the wire that is fed by the wire feeding unit in a direction of curling the wire by the curl guide.

8 Claims, 24 Drawing Sheets

BINDING MACHINE

CROSS-REFERENCE TO RELATED APPLICATIONS

This application is based upon and claims the benefit of priority from prior Japanese patent application No. 2019-044290 filed on Mar. 11, 2019, the entire contents of which are incorporated herein by reference.

TECHNICAL FIELD

The present disclosure relates to a binding machine configured to bind an object to be bound such as a reinforcing bar with a wire.

BACKGROUND ART

In the related art, a binding machine called as a reinforcing bar binding machine configured to wind a wire on two or more reinforcing bars, and to bind the two or more reinforcing bars with the wire by twisting the wire wound on the reinforcing bars is suggested.

The binding machine causes the wire fed by a drive force of a motor to pass through a guide called as a curl guide or the like configured to curl the wire, thereby winding the wire around the reinforcing bars. The curled wire is guided to a binding unit configured to twist a wire by a guide called as an inductive guide or the like and the wire wound around the reinforcing bars is twisted by the binding unit, so that the reinforcing bars is bound with the wire.

In the binding machine, when the wire is continuously fed in a state in which the wire cannot be normally fed, the wire deviates from the feeding path and is bent, which is called buckling. When the buckled wire is pinched in a narrow place, it is difficult to remove the remaining wire. Therefore, a binding machine capable of removing a wire even when the wire deviates from the feeding path and is buckled is suggested (for example, refer to JP-A-2018-109299).

SUMMARY OF DISCLOSURE

If the wire is fed to a guide called a curl guide and the like in a state in which there is an obstacle in a position in which it blocks the feeding path of the wire, the wire comes into contact with the obstacle and cannot be thus fed to a further forward side than the curl guide, so that a feeding trouble of the wire may occur. When the feeding trouble of the wire accompanied by the buckling occurs, it is difficult to remove the wire for which the feeding trouble has occurred.

The present disclosure has been made in view of the above situations, and an object thereof is to provide a binding machine capable of easily removing a wire even when a feeding trouble occurs.

In order to achieve the above object, the present disclosure provides a binding machine including a wire feeding unit configured to feed a wire to be wound on an object to be bound, a binding unit configured to twist the wire wound on the object to be bound, a curl guide configured to curl the wire being fed by the wire feeding unit, an inductive guide configured to guide the wire curled by the curl guide toward the binding unit, and a retraction guide part configured to retract the wire downstream of the binding unit with respect to a feeding direction of the wire that is fed by the wire feeding unit in a direction of curling the wire by the curl guide.

In the present disclosure, if the wire is fed to the curl guide in a state in which there is an obstacle in a position in which it blocks a feeding path of the wire, the wire coming into contact with the obstacle is retracted through the retraction guide part.

According to the present disclosure, even in a state in which there is an obstacle in a position in which it blocks the feeding path of the wire, the wire can be fed to the curl guide, so that it is possible to suppress occurrence of buckling and to easily remove the wire even if a feeding trouble occurs. Therefore, it is possible to suppress occurrence of a failure due to the feeding trouble of the wire.

DETAILED DESCRIPTION OF EMBODIMENTS

Hereinbelow, an example of a reinforcing bar binding machine as an embodiment of the binding machine of the present disclosure will be described with reference to the drawings.

<Example of Reinforcing Bar Binding Machine>

Figure 1:
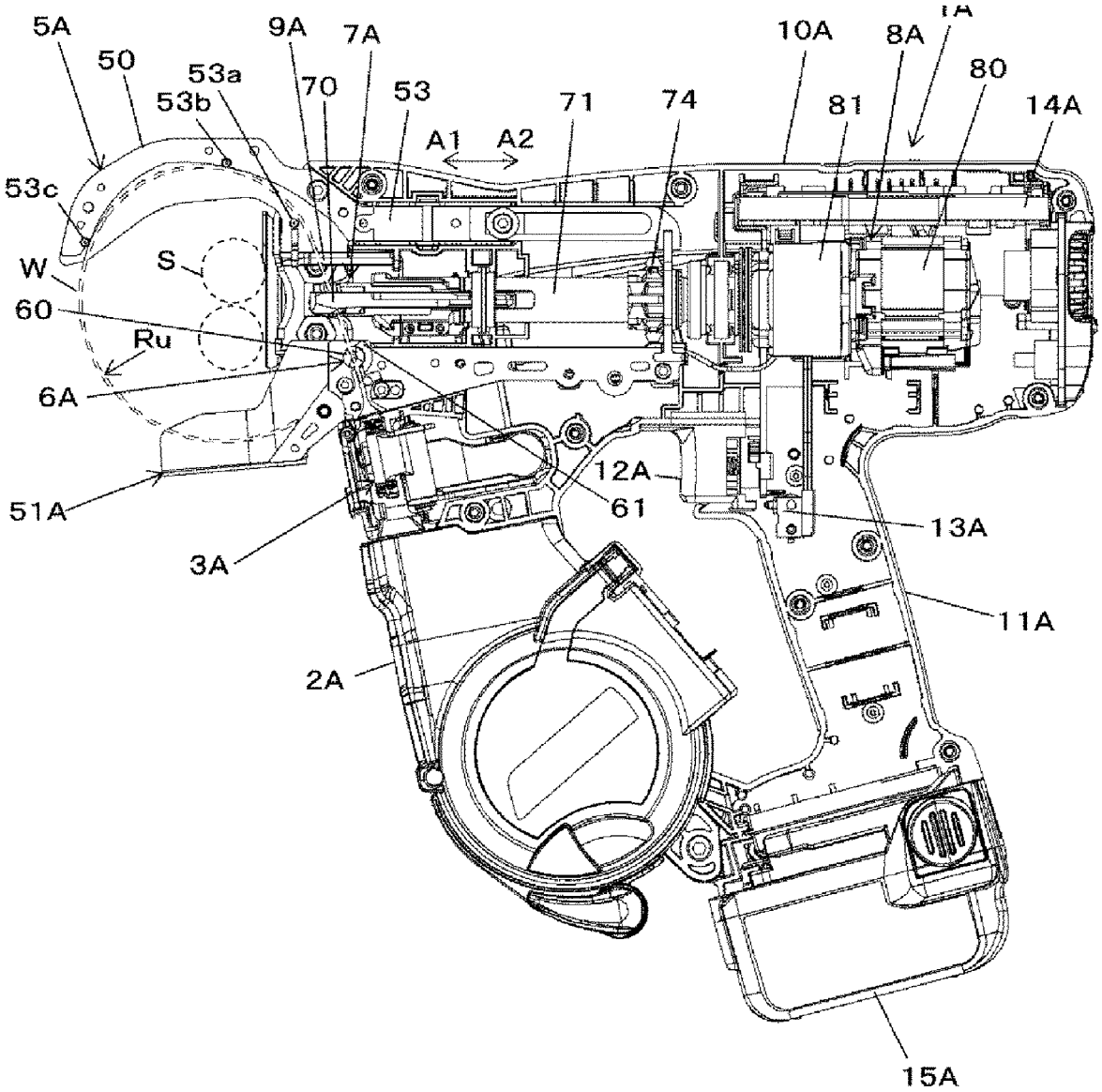
FIG. 1 is a view depicting an example of an entire structure of a reinforcing bar binding machine, as seen from a side.
Figure 2:
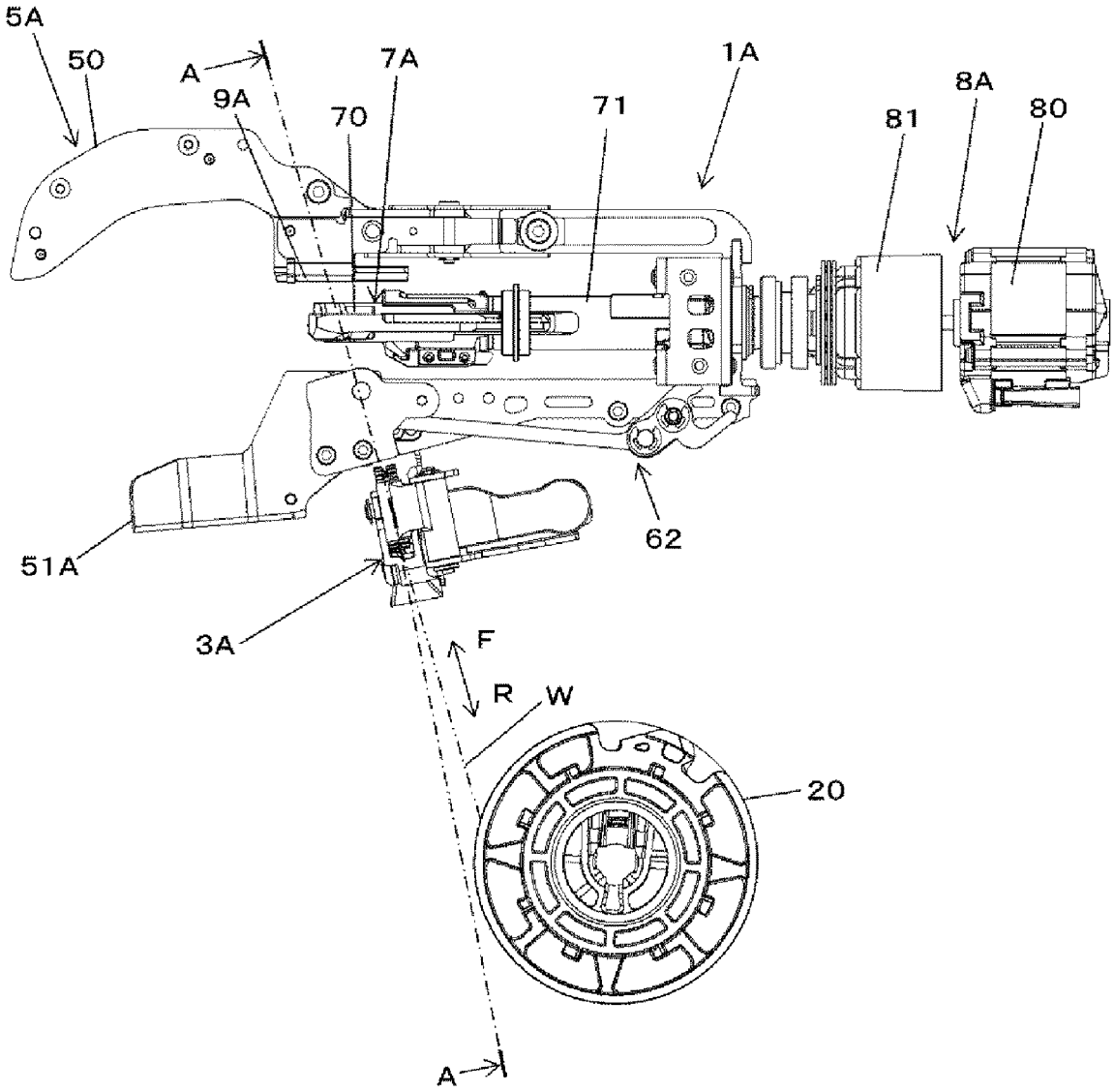
FIG. 2 is a view depicting an example of a main structure of the reinforcing bar binding machine, as seen from a side.
Figure 3:
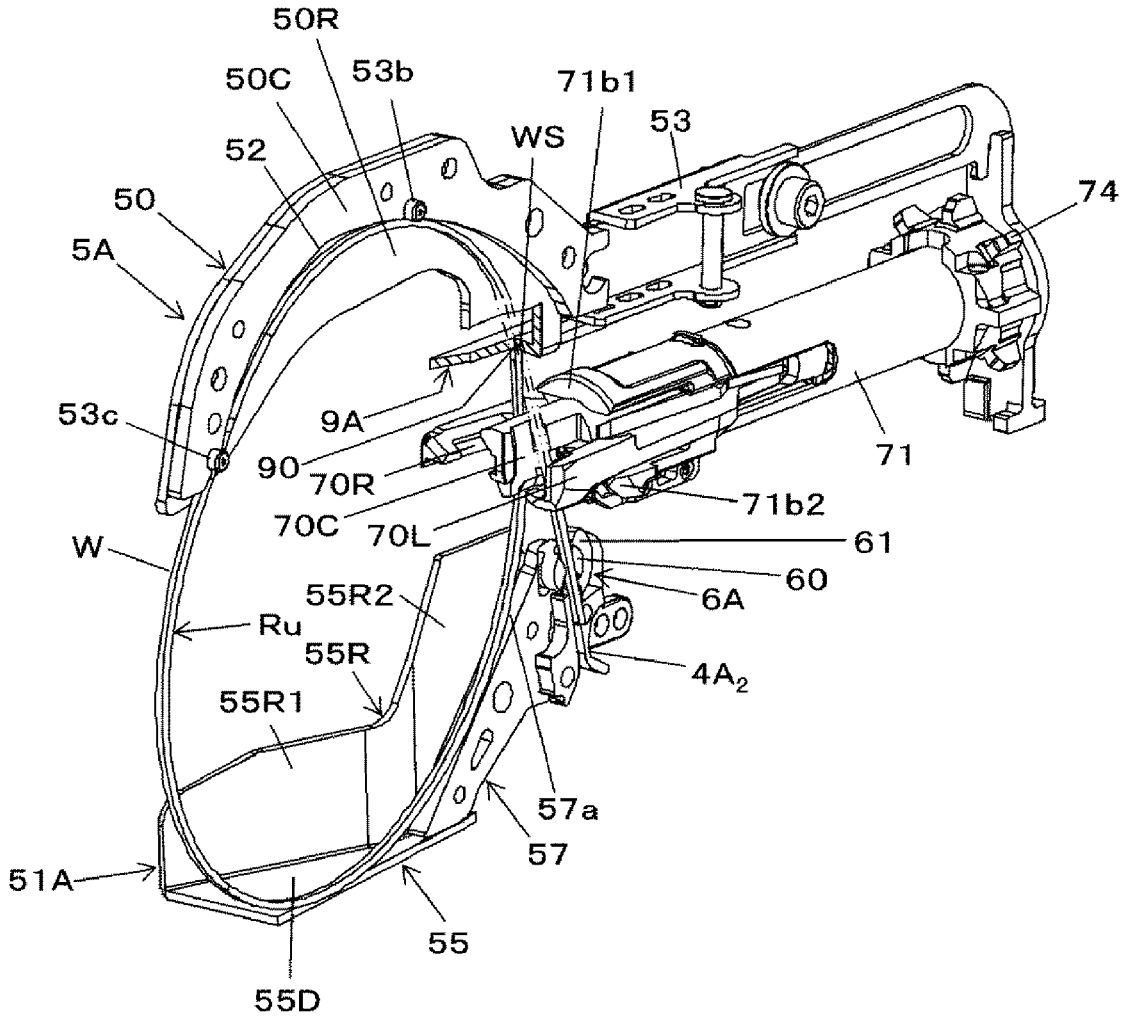
FIG. 3 is a partially broken perspective view depicting an example of the main structure of the reinforcing bar binding machine.
Figure 4A:
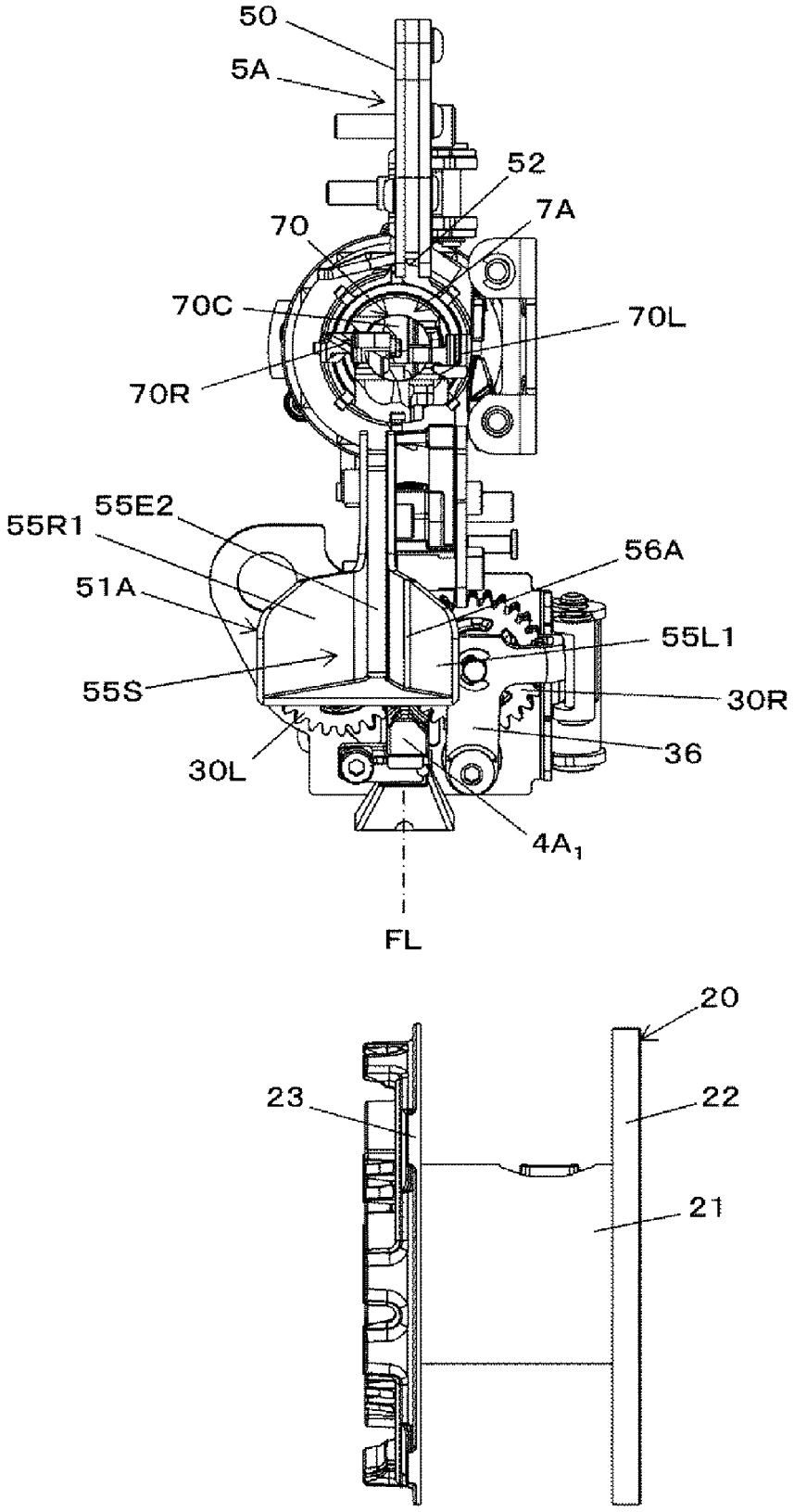
FIG. 4A is a view depicting an example of the entire structure of the reinforcing bar binding machine, as seen from front.
Figure 4B:
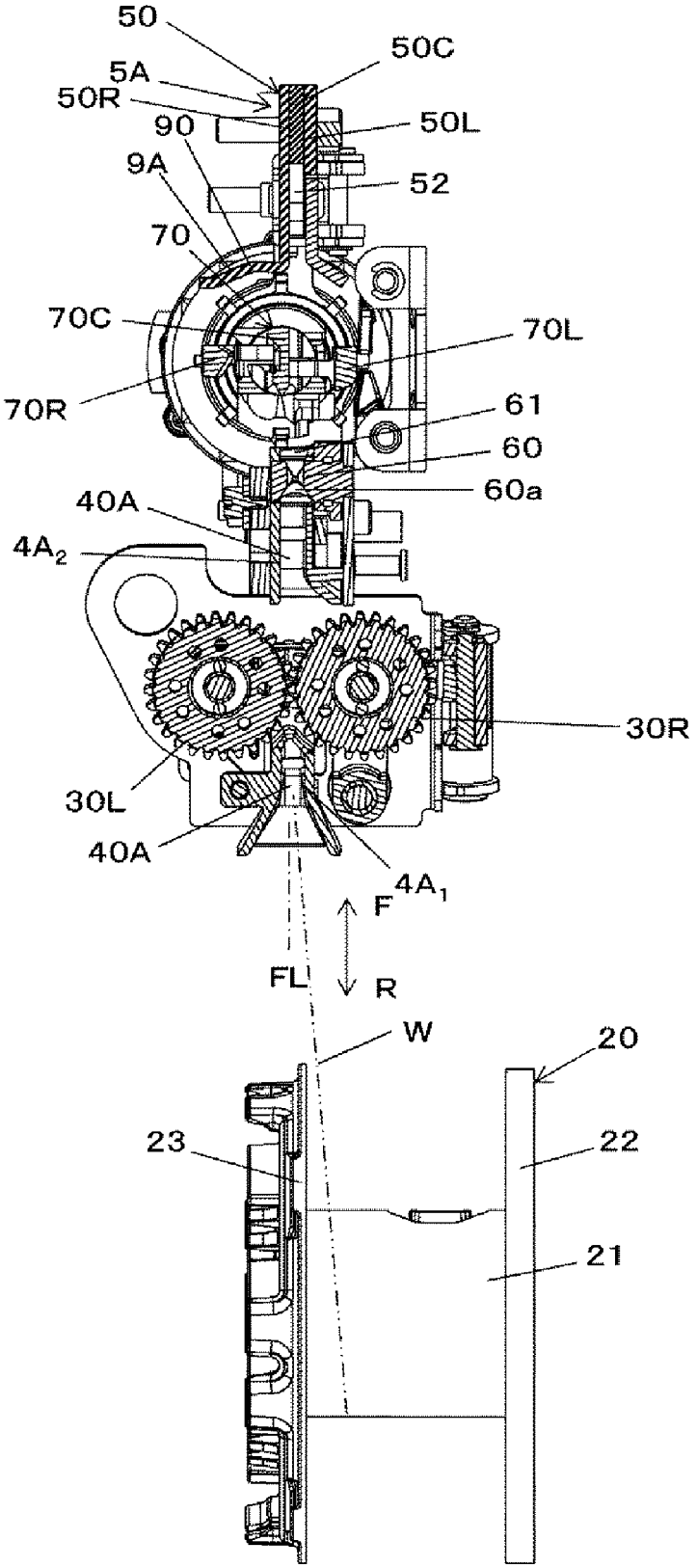
FIG. 4B is a sectional view taken along a line A-A in FIG. 2.
Figure 5:
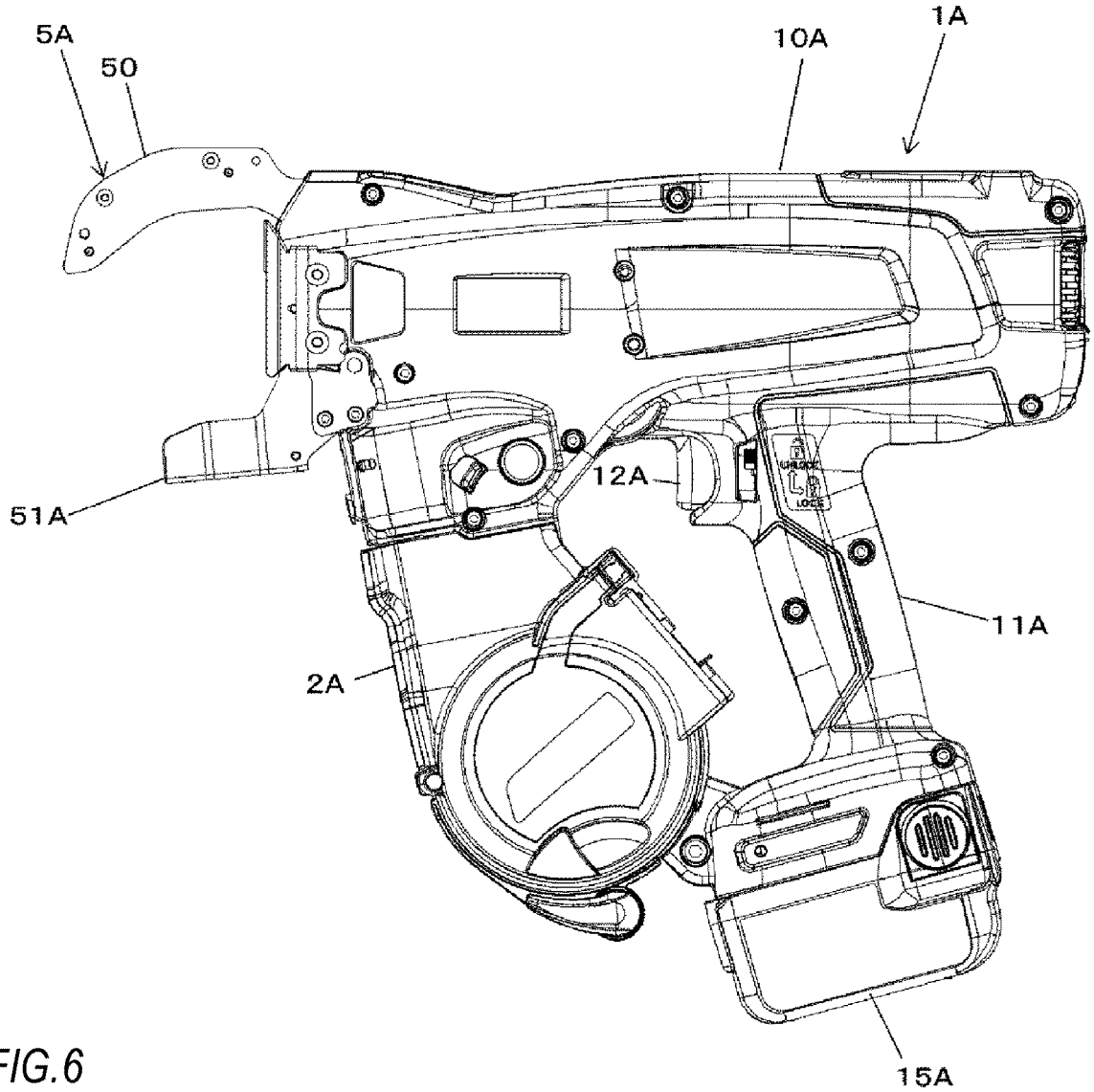
FIG. 5 is a side view depicting an outer shape of the reinforcing bar binding machine.
Figure 6:
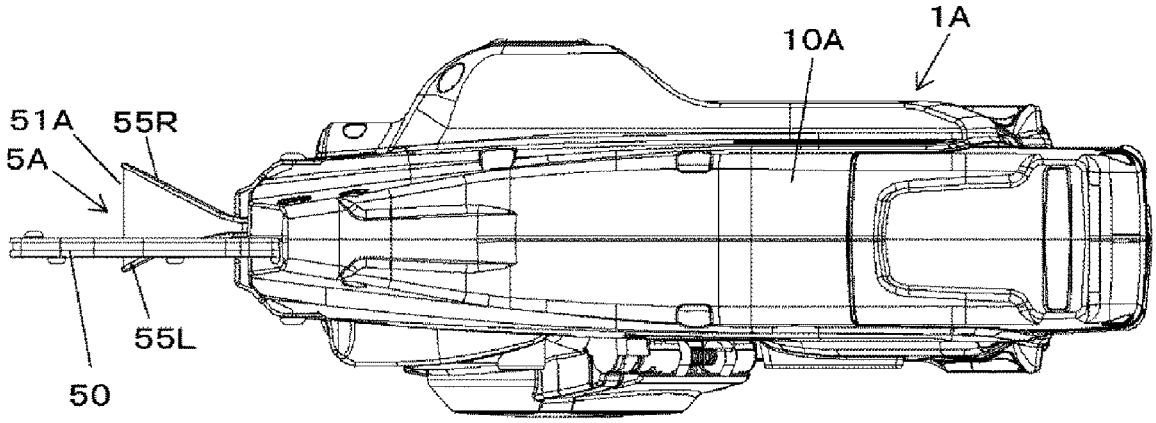
FIG. 6 is a top view depicting the outer shape of the reinforcing bar binding machine.
Figure 7:
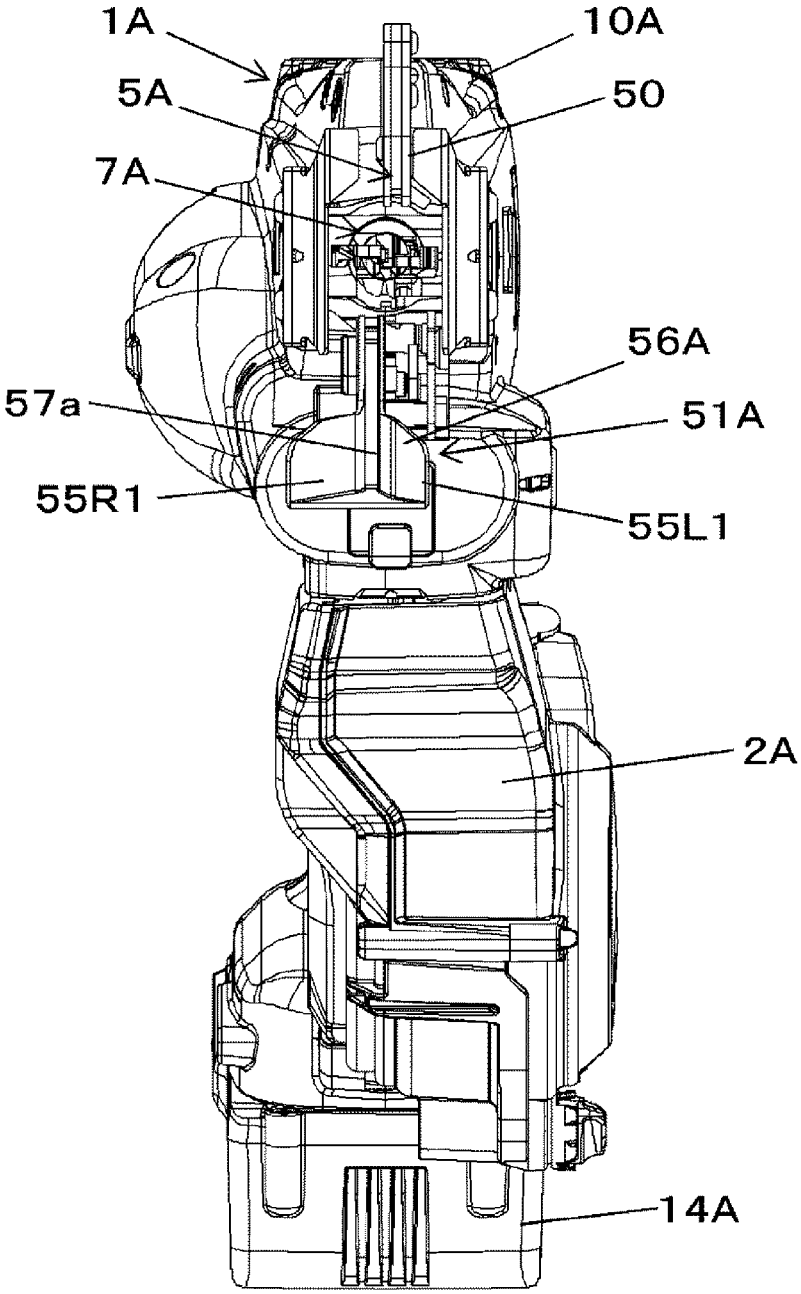
FIG. 7 is a front view depicting the outer shape of the reinforcing bar binding machine.

FIG. 1 is a view depicting an example of an entire structure of a reinforcing bar binding machine, as seen from a side, FIG. 2 is a view depicting an example of a main structure of the reinforcing bar binding machine, as seen from a side, FIG. 3 is a partially broken perspective view depicting an example of the main structure of the reinforcing bar binding machine, FIG. 4A is a view depicting an example of the entire structure of the reinforcing bar binding machine, as seen from front, and FIG. 4B is a sectional view taken along a line A-A in FIG. 2. Also, FIG. 5 is a side view depicting an outer shape of the reinforcing bar binding machine, FIG. 6 is a top view depicting the outer shape of the reinforcing bar binding machine, and FIG. 7 is a front view depicting the outer shape of the reinforcing bar binding machine.

A reinforcing bar binding machine 1A is configured to feed wires W in a forward direction denoted with an arrow F, to wind the wires around reinforcing bars S, which are an object to be bound, to feed the wires W wound around the reinforcing bars S in a reverse direction denoted with an arrow R, to wind the wires on the reinforcing bars S, and to twist the wires W, thereby binding the reinforcing bars S with the wires W.

In order to realize the above functions, the reinforcing bar binding machine 1A includes a magazine 2A in which the wires W are accommodated, and a wire feeding unit 3A configured to feed the wires W. Also, the reinforcing bar binding machine 1A includes a first wire guide $\mathbf{4}A_1$ configured to guide the wires W that are to be fed into the wire feeding unit 3A and a second wire guide $\mathbf{4}A_2$ configured to guide the wires W that are to be delivered from the wire feeding unit 3A, in an operation of feeding the wires W in the forward direction by the wire feeding.

Also, the reinforcing bar binding machine 1A includes a curl forming unit 5A configured to form a path along which the wires W fed by the wire feeding unit 3A are to be wound around the reinforcing bars S. Also, the reinforcing bar binding machine 1A includes a cutting unit 6A configured to cut the wires W wound on the reinforcing bars S during an operation of feeding the wires W in the reverse direction by the wire feeding unit 3A, a binding unit 7A configured to twist the wires W wound on the reinforcing bars S, and a drive unit 8A configured to drive the binding unit 7A.

The magazine 2A is an example of an accommodation unit in which a reel 20 on which the long wires W are wound to be reeled out is rotatably and detachably accommodated. For the wire W, a wire made of a plastically deformable metal wire, a wire having a metal wire covered with a resin, a twisted wire and the like are used.

The reel 20 has a cylindrical hub part 21 on which the wires W are wound, and a pair of flange parts 22 and 23 provided integrally on both axial ends of the hub part 21. The flange parts 22 and 23 each have a substantially circular plate shape having a larger diameter than the hub part 21, and are provided coaxially with the hub part 21. The reel 20 is configured so that two wires W are wound on the hub part 21 and can be reeled out from the reel 20 at the same time.

As shown in FIGS. 4A and 4B, the magazine 2A is mounted with the reel 20 with being offset in one direction along an axis direction of the reel 20 following an axial direction of the hub part 21 with respect to a feeding path FL of the wires W defined by the first wire guide $\mathbf{4}A_1$ and the second wire guide $\mathbf{4}A_2$. In the present example, the entire hub part 21 of the reel 20 is offset in one direction with respect to the feeding path FL of the wires W.

Figure 8A:
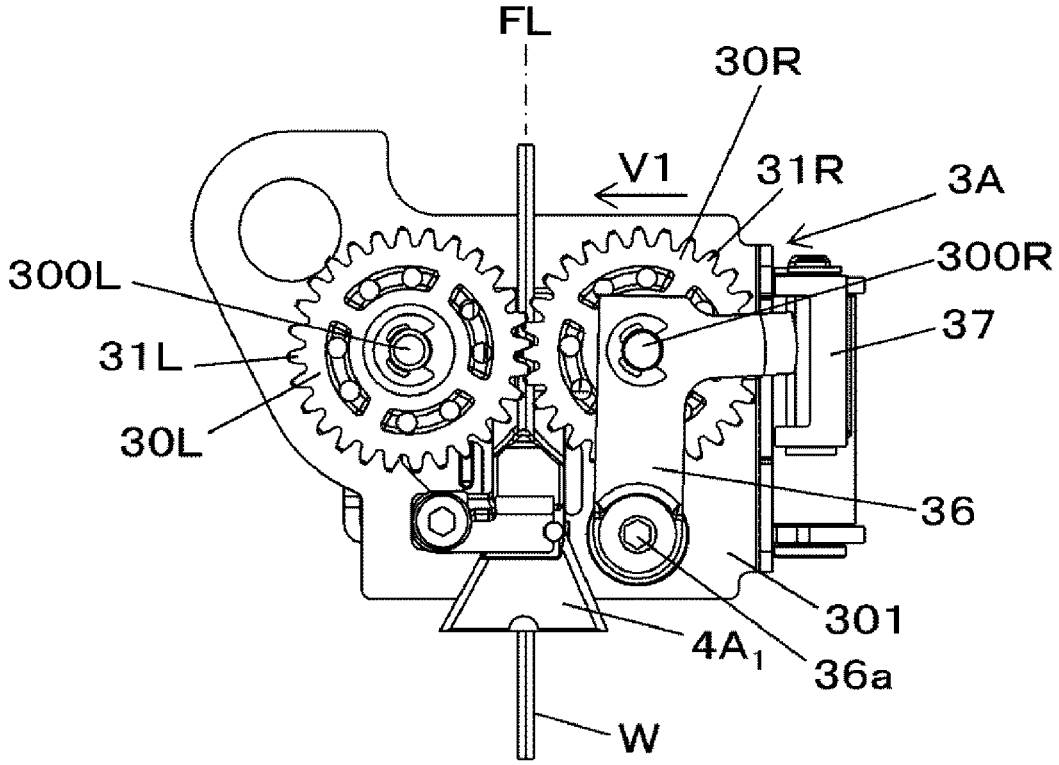
FIG. 8A is a front view depicting an example of a wire feeding unit.
Figure 8B:
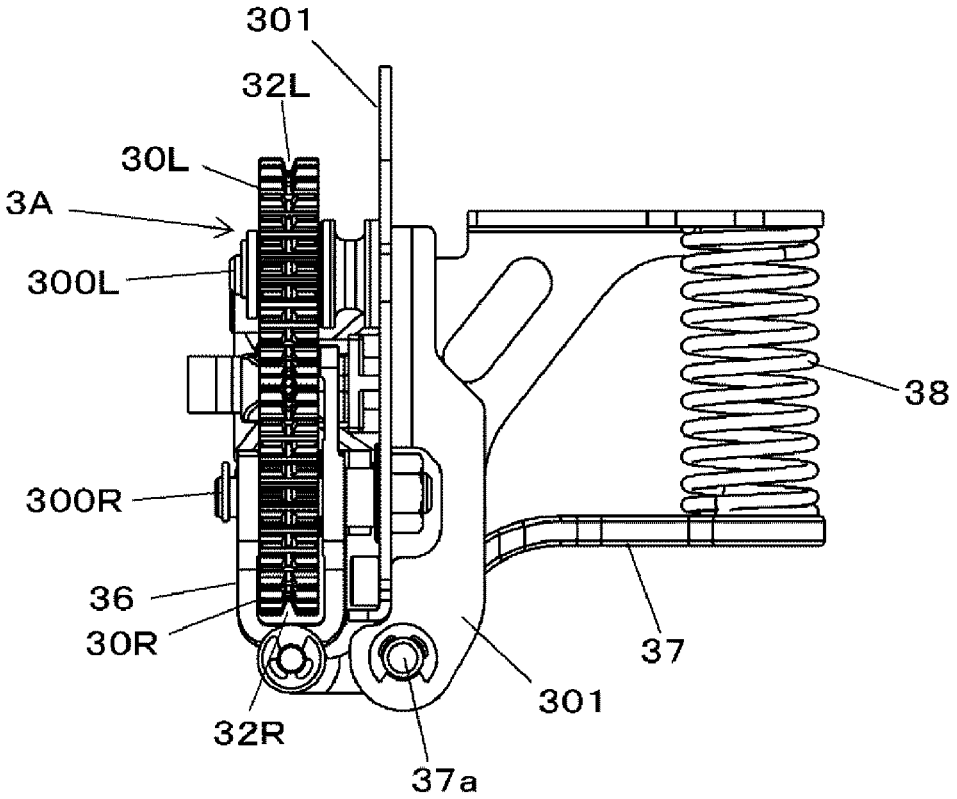
FIG. 8B is a plan view depicting an example of the wire feeding unit.

FIG. 8A is a front view depicting an example of the wire feeding unit, and FIG. 8B is a plan view depicting an example of the wire feeding unit. Subsequently, a structure of the wire feeding unit 3A is described. The wire feeding unit 3A includes, as a pair of feeding members configured to sandwich and feed two wires W aligned in parallel, a first feeding gear 30L and a second feeding gear 30R configured to feed the wires W by a rotating operation.

The first feeding gear 30L has a tooth part 31L configured to transmit a drive force. In the present example, the tooth part 31L has a spur gear shape, and is formed on an entire circumference of an outer periphery of the first feeding gear 30L. Also, the first feeding gear 30L has a groove portion 32L into which the wire W is to enter. In the present example, the groove portion 32L is a concave portion of which a sectional shape is a substantial V shape, and is formed on the entire circumference of the outer periphery of the first feeding gear 30L along a circumferential direction.

The second feeding gear 30R has a tooth part 31R configured to transmit a drive force. In the present example, the tooth part 31R has a spur gear shape, and is formed on an entire circumference of an outer periphery of the second feeding gear 30R. Also, the second feeding gear 30R has a groove portion 32R into which the wire W is to enter. In the present example, the groove portion 32R is a concave portion of which a sectional shape is a substantial V shape, and is formed on the entire circumference of the outer periphery of the second feeding gear 30R along a circumferential direction.

In the wire feeding unit 3A, the groove portion 32L of the first feeding gear 30L and the groove portion 32R of the second feeding gear 30R are arranged to face each other, so that the first feeding gear 30L and the second feeding gear 30R are provided with the feeding path FL of the wires W defined by the first wire guide $4A_1$ and the second wire guide $4A_2$ being interposed therebetween. The feeding path FL of the wires W becomes a width center position of the wire feeding unit 3A configured by the pair of first feeding gear 30L and the second feeding gear 30R. As shown in FIG. 4B and the like, the reel 20 is arranged with being offset in one direction with respect to the width center position of the wire feeding unit 3A.

The wire feeding unit 3A is configured so that the first feeding gear 30L and the second feeding gear 30R can be displaced toward and away from each other. In the present example, the second feeding gear 30R is displaced relative to the first feeding gear 30L.

The first feeding gear 30L is rotatably supported to a support member 301 of the wire feeding unit 3A by a shaft 300L. Also, the wire feeding unit 3A includes a first displacement member 36 configured to displace the second feeding gear 30R toward and away from the first feeding gear 30L. The first displacement member 36 is configured to rotatably support the second feeding gear 30R to one end portion-side by a shaft 300R. Also, the other end portion of the first displacement member 36 is supported to the support member 301 so as to be rotatable about a shaft 36*a* serving as a support point.

The wire feeding unit 3A includes a second displacement member 37 configured to displace the first displacement member 36. The second displacement member 37 is coupled on one end portion-side to the first displacement member 36. Also, the second displacement member 37 is coupled on the other end portion-side to a spring 38. Also, the second displacement member 37 is supported to the support member 301 between one end portion-side and the other end portion-side so as to be rotatable about a shaft 37*a* serving as a support point.

The first displacement member 36 is pressed via the second displacement member 37 by the spring 38, and is displaced in a direction of an arrow V1 by a rotating operation about the shaft 36*a* serving as a support point. Thereby, the second feeding gear 30R is pressed toward the first feeding gear 30L by a force of the spring 38.

In a state in which the two wires W are mounted between the first feeding gear 30L and the second feeding gear 30R, the wires W are sandwiched between the groove portion 32L of the first feeding gear 30L and the groove portion 32R of the second feeding gear 30R in such an aspect that one wire W is put in the groove portion 32L of the first feeding gear 30L and the other wire W is put in the groove portion 32R of the second feeding gear 30R.

In the wire feeding unit 3A, the tooth part 31L of the first feeding gear 30L and the tooth part 31R of the second feeding gear 30R are in mesh with each other in a state in which the wires W are sandwiched between the groove portion 32L of the first feeding gear 30L and the groove portion 32R of the second feeding gear 30R. Thereby, the drive force is transmitted between the first feeding gear 30L and the second feeding gear 30R by rotation.

In the wire feeding unit 3A of the present example, the first feeding gear 30L is a drive side, and the second feeding gear 30R is a driven side.

The first feeding gear 30L is configured to rotate as a rotating operation of a feeding motor (not shown) is transmitted thereto. The second feeding gear 30R is configured to rotate in conjunction with the first feeding gear 30L as a rotating operation of the first feeding gear 30L is transmitted thereto through engagement between the tooth part 31L and the tooth part 31R.

Thereby, the wire feeding unit 3A is configured to feed the wires W sandwiched between the first feeding gear 30L and the second feeding gear 30R along an extension direction of the wires W. In the structure of feeding the two wires W, the two wires W are fed with being aligned in parallel by a frictional force that is generated between the groove portion 32L of the first feeding gear 30L and one wire W, a frictional force that is generated between the groove portion 32R of the second feeding gear 30R and the other wire W, and a frictional force that is generated between one wire W and the other wire W.

The wire feeding unit 3A is configured so that the rotation directions of the first feeding gear 30L and the second feeding gear 30R are switched and the feeding direction of the wires W is switched between the forward and reverse directions by switching the rotation direction of the feeding motor (not shown) between the forward and reverse directions.

Subsequently, the wire guide configured to guide the feeding of the wires W is described. As shown in FIG. 4B, the first wire guide $4A_1$ is arranged upstream of the first feeding gear 30L and the second feeding gear 30R with respect to the feeding direction of the wires W to be fed in the forward direction. Also, the second wire guide $4A_2$ is arranged downstream of the first feeding gear 30L and the second feeding gear 30R with respect to the feeding direction of the wires W to be fed in the forward direction.

The first wire guide $4A_1$ and the second wire guide $4A_2$ each have a guide hole 40A through which the wires W are to pass. The guide hole 40A has a shape for regulating a radial position of the wire W. In the reinforcing bar binding machine 1A, a path of the wires W that are fed by the wire feeding unit 3A is regulated by the curl forming unit 5A, so that a locus of the wires W becomes a loop Ru as shown with a broken line in FIG. 1 and the wires W are thus wound around the reinforcing bars S.

When a direction intersecting with a radial direction of the loop Ru to be formed by the wires W is set as an axial direction, the guide holes 40A of the first wire guide $4A_1$ and the second wire guide $4A_2$ are respectively formed so that the two wires W are to pass therethrough with being aligned in parallel along the axial direction of the loop Ru. In the meantime, the direction in which the two wires W are aligned in parallel is also a direction in which the first feeding gear 30L and the second feeding gear 30R are arranged.

The first wire guide 4$A_1$ and the second wire guide 4$A_2$ have the guide holes 40A provided on the feeding path L of the wires W to pass between the first feeding gear 30L and the second feeding gear 30R. The first wire guide 4$A_1$ is configured to guide the wires W to pass through the guide hole 40A to the feeding path L between the first feeding gear 30L and the second feeding gear 30R.

The first wire guide 4$A_1$ and the second wire guide 4$A_2$ have a wire introduction part, respectively, which is provided upstream of the guide hole 40A with respect to the feeding direction of the wires W to be fed in the forward direction and has a tapered shape of which an opening area is larger than a downstream side, such as a conical shape, a pyramid shape or the like. Thereby, the wires W can be easily introduced into the first wire guide 4$A_1$ and the second wire guide 4$A_2$.

Subsequently, the curl forming unit 5A configured to form the feeding path of the wires W along which the wires W are to be wound around the reinforcing bars S is described. The curl forming unit 5A includes a curl guide 50 configured to curl the wires W that are fed by the first feeding gear 30L and the second feeding gear 30R, and an inductive guide 51A configured to guide the wires W curled by the curl guide 50 toward the binding unit 7A.

The curl guide 50 has a guide groove 52 configuring the feeding path of the wires W, and a first guide pin 53*a*, a second guide pin 53*b* and a third guide pin 53*c* serving as a guide member for curling the wires W in cooperation with the guide groove 52. The curl guide 50 has such a structure that a guide plate 50L, a guide plate 50C and a guide plate 50R are stacked, and a guide surface of the guide groove 52 is configured by the guide plate 50C. Also, sidewall surfaces that are upright from the guide surface of the guide groove 52 is configured by the guide plates 50L and 50R.

The first guide pin 53*a* is provided on an introduction part-side of the curl guide 50, to which the wires W being fed in the forward direction by the first feeding gear 30L and the second feeding gear 30R are introduced. The first guide pin 53*a* is arranged on a radially inner side of the loop Ru to be formed by the wires W with respect to the feeding path of the wires W configured by the guide groove 52. The first guide pin 53*a* is configured to regulate the feeding path of the wires W so that the wires W being fed along the guide groove 52 do not enter the radially inner side of the loop Ru to be formed by the wires W.

The second guide pin 53*b* is provided between the first guide pin 53*a* and the third guide pin 53*c*. The second guide pin 53*b* is arranged on a radially outer side of the loop Ru to be formed by the wires W with respect to the feeding path of the wires W configured by the guide groove 52. A part of a circumferential surface of the second guide pin 53*b* protrudes from the guide groove 52. Thereby, the wires W that are guided by the guide groove 52 come into contact with the second guide pin 53*b* at a part at which the second guide pin 53*b* is provided.

The third guide pin 53*c* is provided on a discharge part-side of the curl guide 50, from which the wires W being fed in the forward direction by the first feeding gear 30L and the second feeding gear 30R are discharged. The third guide pin 53*c* is arranged on a radially outer side of the loop Ru to be formed by the wires W with respect to the feeding path of the wires W configured by the guide groove 52. A part of a circumferential surface of the third guide pin 53*c* protrudes from the guide groove 52. Thereby, the wires W that are guided by the guide groove 52 come into contact with the third guide pin 53*c* at a part at which the third guide pin 53*c* is provided.

The curl forming unit 5A includes a retraction mechanism 53 configured to retract the first guide pin 53*a*. The retraction mechanism 53 is configured to retract the first guide pin 53*a* from a moving path of the wires W wound on the reinforcing bars S by an operation of moving laterally the first guide pin 53*a* with respect to an axial direction of the first guide pin 53*a* to feed the wires W in the reverse direction by the first feeding gear 30L and the second feeding gear 30R.

Subsequently, an operation of curling the wires W is described. The wires W that are fed in the forward direction by the first feeding gear 30L and the second feeding gear 30R are curled in a loop shape as the radial position of the loop Ru to be formed by the wires W is regulated at least at three points of two points on the radially outer side of the loop Ru to be formed by the wires W and one point on the radially inner side between the two points.

In the present example, a radially outer position of the loop Ru to be formed by the wires W is regulated at two points of the second wire guide 4$A_2$ provided upstream of the first guide pin 53*a* and the third guide pin 53*c* provided downstream of the first guide pin 53*a* with respect to the feeding direction of the wires W that are fed in the forward direction. Also, a radially inner position of the loop Ru to be formed by the wires W is regulated by the first guide pin 53*a*. Thereby, the wires W that are fed in the forward direction by the first feeding gear 30L and the second feeding gear 30R are curled in a loop shape.

In the meantime, in the radially outer position of the loop Ru to be formed by the wires W, the guide groove 52 in a position in which the wires W being fed to the third guide pin 53*c* is contacted is provided with the second guide pin 53*b*, so that the wear of the guide groove 52 can be prevented.

Figure 9A:
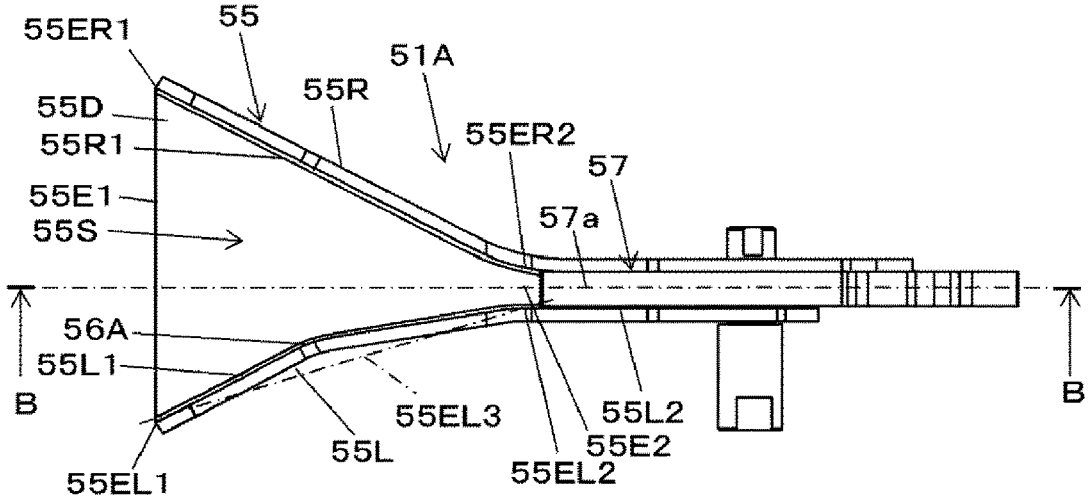
FIG. 9A is a plan view depicting an inductive guide of a first embodiment.
Figure 9B:
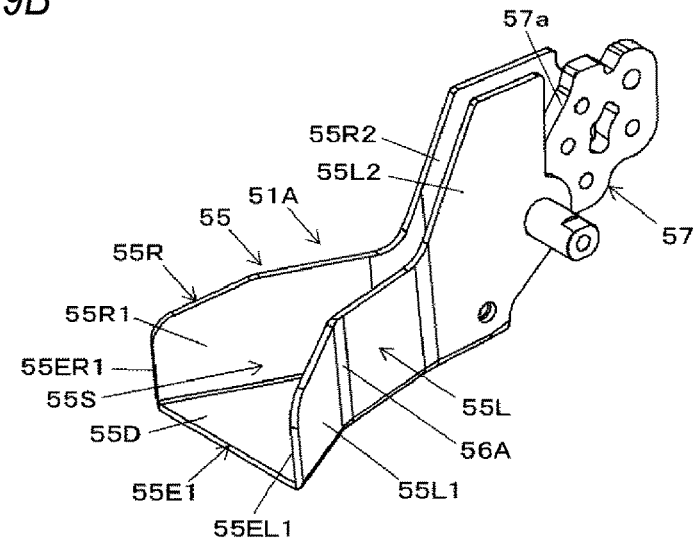
FIG. 9B is a perspective view depicting the inductive guide of the first embodiment.
Figure 9C:
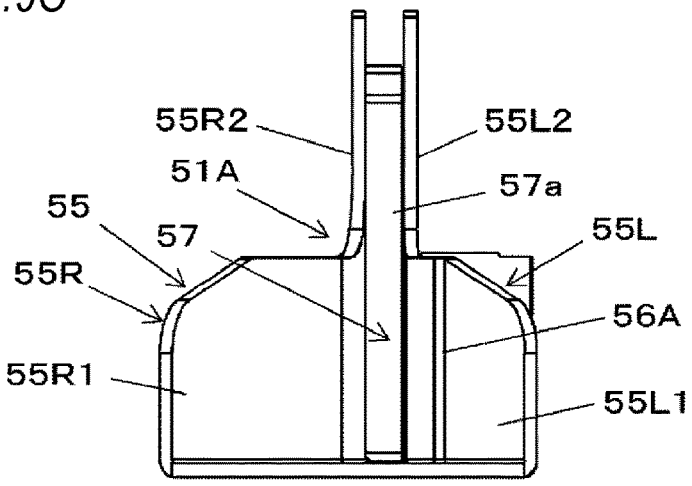
FIG. 9C is a front view depicting the inductive guide of the first embodiment.
Figure 9D:
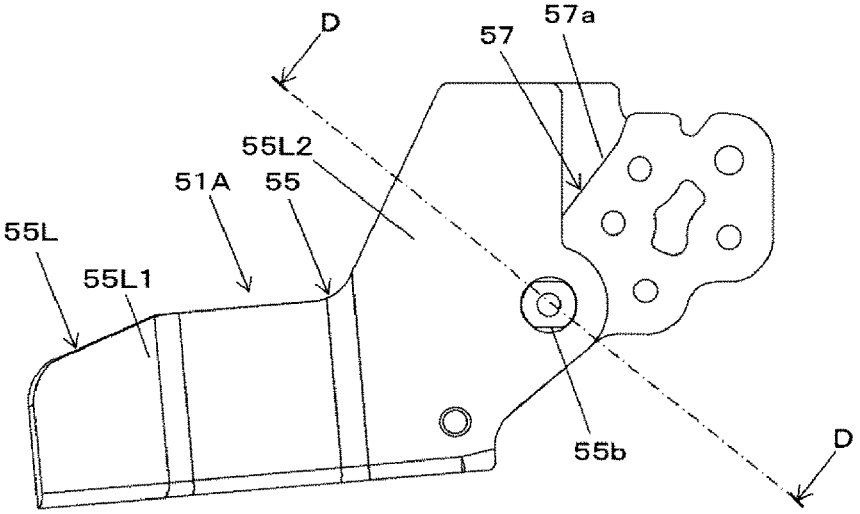
FIG. 9D is a side view depicting the inductive guide of the first embodiment.
Figure 9E:
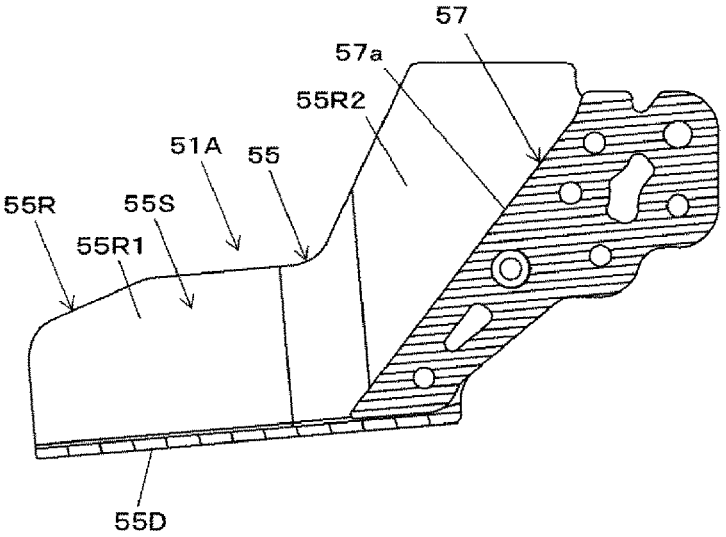
FIG. 9E is a sectional view taken along a line B-B in FIG. 9A.
Figure 9F:
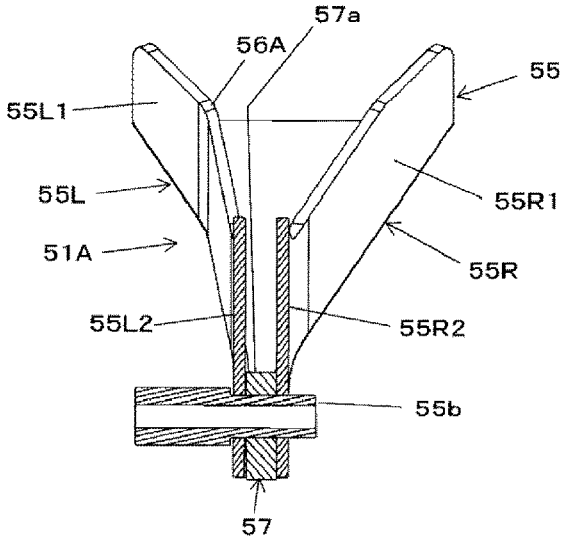
FIG. 9F is a sectional view taken along a line D-D in FIG. 9D.
Figure 9G:
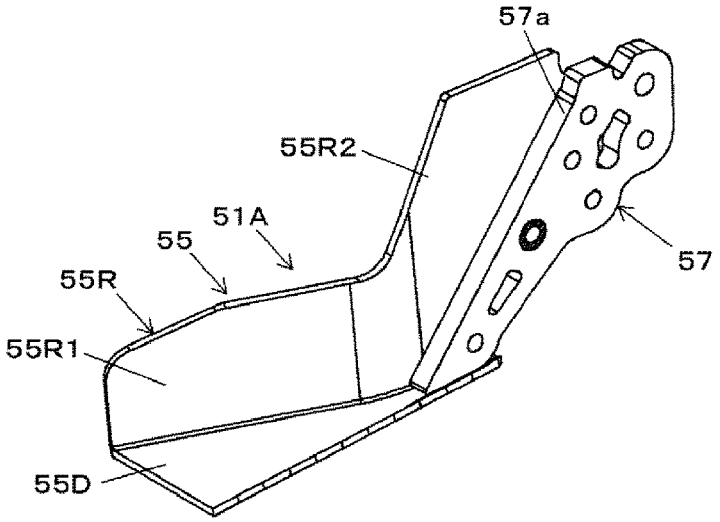
FIG. 9G is a broken perspective view depicting the inductive guide of the first embodiment.

FIG. 9A is a plan view depicting an inductive guide of a first embodiment, FIG. 9B is a perspective view depicting the inductive guide of the first embodiment, FIG. 9C is a front view depicting the inductive guide of the first embodiment, and FIG. 9D is a side view depicting the inductive guide of the first embodiment. Also, FIG. 9E is a sectional view taken along a line B-B in FIG. 9A, FIG. 9F is a sectional view taken along a line D-D in FIG. 9D, and FIG. 9G is a broken perspective view depicting the inductive guide of the first embodiment.

Subsequently, an inductive guide 51A of a first embodiment is described. As shown in FIG. 4A, the inductive guide 51A is provided in a position offset in the other direction that is an opposite direction to the one direction in which the reel 20 is offset, with respect to the feeding path FL of the wires W defined by the first wire guide 4$A_1$ and the second wire guide 4$A_2$.

The inductive guide 51A has a first guide part 55 configured to regulate an axial position of the loop Ru to be formed by the wires W curled by the curl guide 50 and a second guide part 57 configured to regulate a radial position of the loop Ru to be formed by the wires W.

The first guide part 55 is provided on an introduction-side to which the wires W curled by the curl guide 50 are to be introduced, with respect to the second guide part 57. The first guide part 55 has a side surface part 55L provided on one side that is a side on which the reel 20 is positioned with being offset in one direction. Also, the first guide part 55 has a side surface part 55R facing the side surface part 55L and provided on the other side that is a side located in an opposite direction to one direction in which the reel 2 is offset. Also, the first guide part 55 has a bottom surface part 55D on which the side surface part 55L is erected on one side thereof and the side surface part 55R is erected on the other side thereof, the bottom surface part 55D connecting the side surface part 55L and the side surface part 55R.

The second guide part 57 has a guide surface 57*a* provided on a radially outer side of the loop Ru to be formed by the wires W and configured by a surface extending toward the binding unit 7A along the feeding direction of the wires W.

The side surface part 55L on one side of the first guide part 55 has a first guiding part 55L1 configured to guide the wires W to the guide surface 57*a* of the second guide part 57 and a second guiding part 55L2 configured to guide the wires W along the guide surface 57*a*.

The side surface part 55R on the other side of the first guide part 55 has a third guiding part 55R1 configured to guide the wires W to the guide surface 57*a* of the second guide part 57 and a fourth guiding part 55R2 configured to guide the wires W along the guide surface 57*a*.

The inductive guide 51A configures a converging passage 55S by a space surrounded by the pair of side surface parts 55L and 55R and the bottom surface part 55D. Also, the inductive guide 51A is formed with an opening end portion 55E1 from which the wires W are to be introduced into the converging passage 55S. The opening end portion 55E1 is an end portion of the first guide part 55 on a side distant from the second guide part 57, and is opened toward the space surrounded by the pair of side surface parts 55L and 55R and the bottom surface part 55D.

The first guide part 55 is formed so that an interval between the first guiding part 55L1 and the third guiding part 55R1 gradually decreases from the opening end portion 55E1 toward the guide surface 57*a* of the second guide part 57. Thereby, the first guide part 55 is formed so that the interval between the first guiding part 55L1 and the third guiding part 55R1 is greatest between an opening end portion 55EL1 of the first guiding part 55L1 and an opening end portion 55ER1 of the third guiding part 55R1, which are located at the opening end portion 55E1.

Also, the first guide part 55 is formed so that the second guiding part 55L2 connecting to the first guiding part 55L1 is located on one side of the guide surface 57*a* of the second guide part 57 and the fourth guiding part 55R2 connecting to the third guiding part 55R1 is located on the other side of the guide surface 57*a*. The second guiding part 55L2 and the fourth guiding part 55R2 face in parallel to each other with a predetermined interval equal to or greater than a radial width of two wires W aligned in parallel.

Thereby, the interval between the first guiding part 55L1 and the third guiding part 55R1 is narrowest at a part at which the first guiding part 55L1 connects to the second guiding part 55L2 and the third guiding part 55R1 connects to the fourth guiding part 55R2. Therefore, the part at which the first guiding part 55L1 and the second guiding part 55L2 connect each other becomes a narrowest part 55EL2 of the first guiding part 55L1 with respect to the third guiding part 55R1. Also, the part at which the third guiding part 55R1 and the fourth guiding part 55R2 connect each other becomes a narrowest part 55ER2 of the third guiding part 55R1 with respect to the first guiding part 55L1.

Thereby, the inductive guide 51A is formed so that a part between the narrowest part 55EL2 of the first guiding part 55L1 and the narrowest part 55ER2 of the third guiding part 55R1 becomes a narrowest part 55E2 of the converging passage 55S. The inductive guide 51A is formed so that a cross-sectional area of the converging passage 55S gradually decreases from the opening end portion 55E1 toward the narrowest part 55E2 along an entry direction of the wires W.

The inductive guide 51A has an entry angle regulation part 56A configured to change an entry angle of the wires W entering the converging passage 55S so as to face toward the narrowest part 55E2.

In the reinforcing bar binding machine 1A, the reel 20 is arranged with being offset in one direction. The wires W that are fed from the reel 20 offset in one direction by the wire feeding unit 3A and are curled by the curl guide 50 are directed toward the other direction that is an opposite direction to one direction in which the reel 20 is offset.

For this reason, the wires W to enter the converging passage 55S between the side surface part 55L and the side surface part 55R of the first guide part 55 first enters toward the third guiding part 55R1 of the side surface part 55R. Tip ends of the wires W entering toward the third guiding part 55R1 of the side surface part 55R are directed toward between the narrowest part 55EL2 of the first guiding part 55L1 and the narrowest part 55ER2 of the third guiding part 55R1, i.e., toward the narrowest part 55E2 of the converging passage 55S. Therefore, the first guiding part 55L1 of the side surface part 55L facing the side surface part 55R is provided with the entry angle regulation part 56A.

The entry angle regulation part 56A is provided in a position protruding toward an inner side of a virtual line interconnecting the opening end portion 55E1 of the converging passage 55S and the narrowest part 55E2, in the present example, a virtual line 55EL3 interconnecting the opening end portion 55E1 of the converging passage 55S and the narrowest part 55E2, the inner side being located closer to the side surface part 55R than the virtual line 55EL3. In the present example, the entry angle regulation part 56A has such a shape that an intermediate portion of the first guiding part 55L1 between the opening end portion 55EL1 and the narrowest part 55EL2 is made convex toward the third guiding part 55R1. Thereby, the first guiding part 55L1 has a bent shape, as seen from top (FIG. 9A).

The wires curled by the curl guide 50 are introduced between the pair of side surface parts 55L and 55R of the first guide part 55. The inductive guide 51A is configured to regulate an axial position of the loop Ru to be formed by the wires W by the first guiding part 55L1 and the third guiding part 55R1 of the first guide part 55 and to guide the same to the guide surface 57*a* of the second guide part 57.

Also, the inductive guide 51A is configured to regulate an axial position of the loop Ru to be formed by the wires W guided to the guide surface 57*a* of the second guide part 57 by the second guiding part 55L2 and the fourth guiding part 55R2 of the first guide part 55, and to regulate a radial position of the loop Ru to be formed by the wires W by the guide surface 57*a* of the second guide part 57.

In the inductive guide 51A of the present example, the second guide part 57 is fixed to a main body part 10A of the reinforcing bar binding machine 1A, and the first guide part 55 is fixed to the second guide part 57. In the meantime, the first guide part 55 may be supported to the second guide part 57 in a state in which it can rotate about a shaft 55*b* as a support point. In this structure, the first guide part 55 is configured to be openable/closable in directions of contacting and separating with respect to the curl guide 50 in a state in which the opening end portion 55E1-side is urged toward the curl guide 50 by a spring (not shown). Thereby, after binding the reinforcing bars S with the wires W, the first guide part 55 is retracted by an operation of pulling out the reinforcing bar binding machine 1A from the reinforcing bars S, so that the reinforcing bar binding machine 1A can be easily pulled out from the reinforcing bars S.

Subsequently, the cutting unit 6A configured to cut the wires W wound on the reinforcing bars S is described. The cutting unit 6A includes a fixed blade part 60, a movable blade part 61 configured to cut the wires W in cooperation with the fixed blade part 60, and a transmission mechanism 62 configured to transmit an operation of the binding unit 7A to the movable blade part 61. The fixed blade part 60 has an opening 60*a* through which the wires W are to pass, and an edge portion provided at the opening 60*a* and capable of cutting the wires W.

The movable blade part 61 is configured to cut the wires W passing through the opening 60*a* of the fixed blade part 60 by a rotating operation about the fixed blade part 60, which is a support point. The transmission mechanism 62 is configured to transmit an operation of the binding unit 7A to the movable blade part 61 and to rotate the movable blade part 61 in conjunction with an operation of the binding unit 7A, thereby cutting the wires W.

The fixed blade part 60 is provided downstream of the second wire guide 4$A_2$ with respect to the feeding direction of the wires W that are fed in the forward direction, and the opening 60*a* configures a wire guide.

Figure 10A:
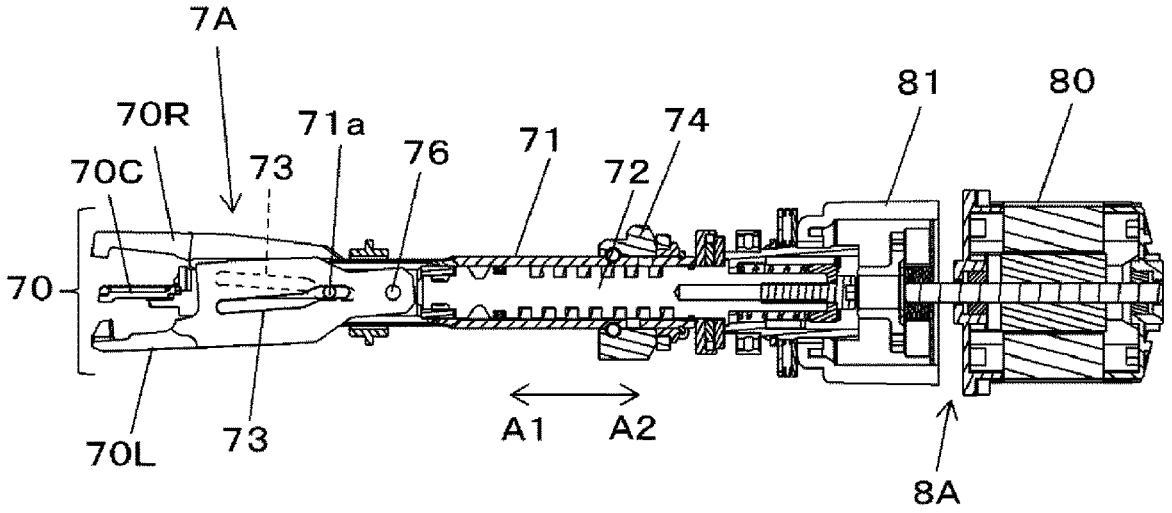
FIG. 10A is a sectional plan view depicting an example of a binding unit and a drive unit.
Figure 10B:
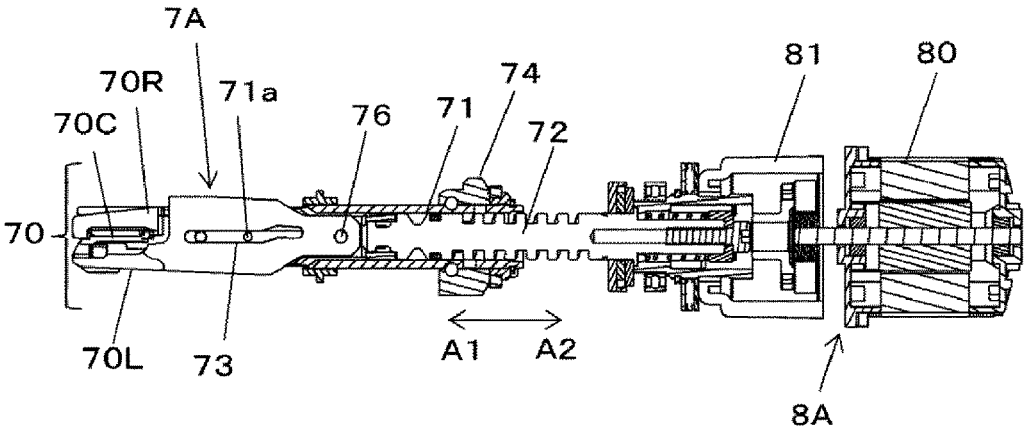
FIG. 10B is a sectional plan view depicting an example of the binding unit and the drive unit.
Figure 10C:
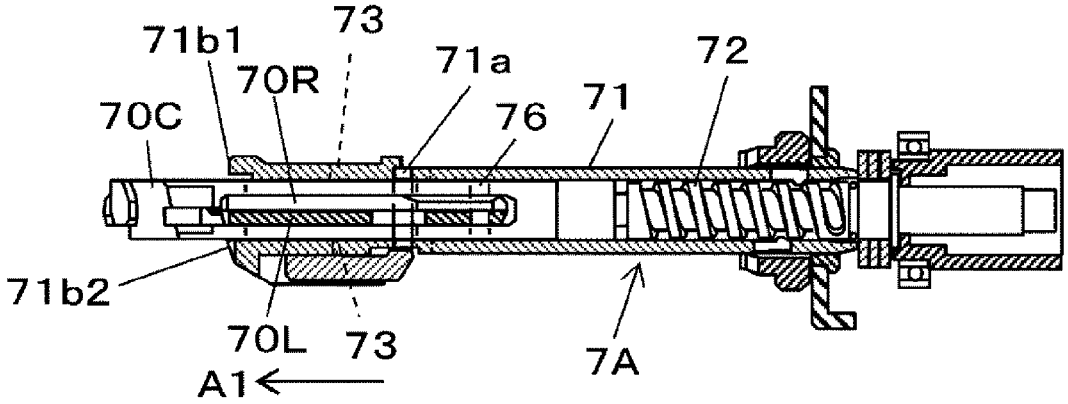
FIG. 10C is a sectional side view depicting an example of the binding unit and the drive unit.

FIGS. 10A and 10B are plan views depicting an example of the binding unit and the drive unit, and FIG. 10C is a side view depicting an example of the binding unit and the drive unit. In the below, the binding unit 7A configured to bind the reinforcing bars S with the wires W and the drive unit 8A configured to drive the binding unit 7A are described.

The binding unit 7A includes an engaging member 70 to which the wires W are to be engaged, an actuating member 71 configured to open/close the engaging member 70, and a rotary shaft 72 for actuating the engaging member 70 and the actuating member 71.

The engaging member 70 includes a first movable engaging member 70L, a second movable engaging member 70R, and a fixed engaging member 70C. The engaging member 70 is configured so that a tip end-side of the first movable engaging member 70L is positioned on one side with respect to the fixed engaging member 70C and a tip end-side of the second movable engaging member 70R is positioned on the other side with respect to the fixed engaging member 70C.

The engaging member 70 is configured so that rear ends of the first movable engaging member 70L and the second movable engaging member 70R are supported to the fixed engaging member 70C so as to be rotatable about a shaft 76. Thereby, the engaging member 70 opens/closes in directions in which the tip end-side of the first movable engaging member 70L contacts and separates with respect to the fixed engaging member 70C by a rotating operation about the shaft 76 as a support point. Also, the engaging member opens/closes in directions in which the tip end-side of the second movable engaging member 70R contacts and separates with respect to the fixed engaging member 70C.

The actuating member 71 and the rotary shaft 72 are configured so that a rotating operation of the rotary shaft 72 is converted into movement of the actuating member 71 in a front and rear direction along an axial direction of the rotary shaft 72 shown with arrows A1 and A2 by a screw part provided on an outer periphery of the rotary shaft 72 and a screw part provided on an inner periphery of the actuating member 71. The actuating member 71 has an opening/closing pin 71*a* for opening/closing the first movable engaging member 70L and the second movable engaging member 70R.

The opening/closing pin 71*a* is inserted in opening/closing guide holes 73 formed in the first movable engaging member 70L and the second movable engaging member 70R. The opening/closing guide hole 73 extends in a moving direction of the actuating member 71, and has a shape of converting linear movement of the opening/closing pin 71*a* moving in conjunction with the actuating member 71 into an opening/closing operation by rotation of the first movable engaging member 70L and the second movable engaging member 70R about the shaft 76 as a support point. In FIGS. 10A and 10B, the opening/closing guide hole 73 formed in the first movable engaging member 70L is shown. However, the second movable engaging member 70R is also provided with the similar opening/closing guide hole 73 having a bilaterally symmetrical shape.

In the binding unit 7A, a side on which the engaging member 70 is provided is referred to as a front side, and a side on which the actuating member 71 is provided is referred to as a rear side. The engaging member 70 is configured so that, when the actuating member 71 is moved rearward (refer to the arrow A2), the first movable engaging member 70L and the second movable engaging member 70R move away from the fixed engaging member 70C by a rotating operation about the shaft 76 as a support point, due to a locus of the opening/closing pin 71*a* and a shape of the opening/closing guide hole 73, as shown in FIG. 10A.

Thereby, the first movable engaging member 70L and the second movable engaging member 70A are opened with respect to the fixed engaging member 70C, so that a feeding path through which the wires W are to pass is formed between the first movable engaging member 70L and the fixed engaging member 70C and between the second movable engaging member 70R and the fixed engaging member 70C.

In a state in which the first movable engaging member 70L and the second movable engaging member 70R are opened with respect to the fixed engaging member 70C, the wires W that are fed by the first feeding gear 30L and the second feeding gear 30R are guided to the first wire guide 4$A_1$ and the second wire guide 4$A_2$ and passes between the fixed engaging member 70C and the first movable engaging member 70L. The wires W passing between the fixed engaging member 70C and the first movable engaging member 70L are guided to the curl forming unit 5A. Also, the wires W curled by the curl forming unit 5A and guided to the binding unit 7A passes between the fixed engaging member 70C and the second movable engaging member 70R.

The engaging member 70 is configured so that, when the actuating member 71 is moved in the forward direction denoted with the arrow A1, the first movable engaging member 70L and the second movable engaging member 70R move toward the fixed engaging member 70C by the rotating operation about the shaft 76 as a support point, due to the locus of the opening/closing pin 71*a* and the shape of the opening/closing guide hole 73, as shown in FIG. 10B. Thereby, the first movable engaging member 70L and the second movable engaging member 70A are closed with respect to the fixed engaging member 70C.

When the first movable engaging member 70L is closed with respect to the fixed engaging member 70C, the wires W sandwiched between the first movable engaging member 70L and the fixed engaging member 70C are engaged in such an aspect that the wires can move between the first movable engaging member 70L and the fixed engaging member 70C. Also, when the second movable engaging member 70R is closed with respect to the fixed engaging member 70C, the wires W sandwiched between the second movable engaging member 70R and the fixed engaging member 70C are engaged in such an aspect that the wires cannot come off between the second movable engaging member 70R and the fixed engaging member 70C.

The actuating member 71 has a bending part 71*b*1 configured to push and bend tip ends WS (one end portions) of the wires W in a predetermined direction, and a bending part 71*b*2 configured to push and bend termination ends WE (other end portions) of the wires W cut by the cutting unit 6A in a predetermined direction The actuating member 71 is moved in the forward direction denoted with the arrow A1, so that the tip ends WS of the wires W engaged by the fixed engaging member 70C and the second movable engaging member 70R are pushed and are thus bent toward the reinforcing bars S by the bending part 71*b*1. Also, the actuating member 71 is moved in the forward direction denoted with the arrow A1, so that the termination ends WE of the wires engaged by the fixed engaging member 70C and the second movable engaging member 70R and cut by the cutting unit 6A are pushed and are thus bent toward the reinforcing bars S by the bending part 71*b*2.

The binding unit 7A includes a rotation regulation part 74 configured to regulate rotations of the engaging member 70 and the actuating member 71 in conjunction with the rotating operation of the rotary shaft 72. The rotation regulation part 74 is provided to the actuating member 71. The rotation regulation part 74 is engaged to an engaging part (not shown) from an operating area in which the wires W are engaged by the engaging member 70 to an operating area in which the wires W are bent by the bending parts 71*b*1 and 71*b*2 of the actuating member 71. Thereby, the rotation of the actuating member 71 in conjunction with the rotation of the rotary shaft 72 is regulated, so that the actuating member 71 is moved in the front and rear direction by the rotating operation of the rotary shaft 72. Also, in an operating area in which the wires W engaged by the engaging member 70 are twisted, the rotation regulation part 74 is disengaged from the engaging part (not shown), so that the actuating member 71 is rotated in conjunction with the rotation of the rotary shaft 72. The first movable engaging member 70L, the second movable engaging member 70R and the fixed engaging member 70C of the engaging member 70 engaging the wires W are rotated in conjunction with the rotation of the actuating member 71.

The drive unit 8A includes a motor 80, and a decelerator 81 for deceleration and torque amplification. The binding unit 7A and the drive unit 8A are configured so that the rotary shaft 72 and the motor 80 are coupled via the decelerator 81 and the rotary shaft 72 is driven via the decelerator 81 by the motor 80.

The retraction mechanism 53 of the first guide pin 53*a* is configured by a link mechanism configured to convert movement of the actuating member 71 in the front and rear direction into displacement of the first guide pin 53*a*. Also, the transmission mechanism 62 of the movable blade part 61 is configured by a link mechanism configured to convert movement of the actuating member 71 in the front and rear direction into a rotating operation of the movable blade part 61.

Subsequently, the feeding regulation unit 9A configured to regulate the feeding of the wires W is described. The feeding regulation unit 9A is configured by providing a member, to which the tip ends WS of the wires W are to be butted, on the feeding path of the wires W to pass between the fixed engaging member 70C and the second movable engaging member 70R. As shown in FIGS. 3 and 4B, the feeding regulation unit 9A of the present example is configured integrally with the guide plate 50R configuring the curl guide 50 and protrudes from the guide plate 50R in a direction intersecting with the feeding path of the wires W.

The feeding regulation unit 9A includes a parallel alignment regulation part 90 configured to guide a parallel alignment direction of the wires W. The parallel alignment regulation part 90 is configured by providing a surface of the feeding regulation unit 9A that the wires W are to come into contact with a concave part extending in a direction intersecting with a parallel alignment direction of the two wires W to be regulated by the first wire guide $4A_1$ and the second wire guide $4A_2$.

Subsequently, a shape of the reinforcing bar binding machine 1A is described. The reinforcing bar binding machine 1A has such a shape that an operator grips with a hand, and includes a main body part 10A and a handle part 11A. The main body part 10A of the reinforcing bar binding machine 1A is provided at an end portion on a front side thereof with the curl guide 50 and the inductive guide 51A of the curl forming unit 5A. Also, the handle part 11A of the reinforcing bar binding machine 1A extends downwardly from the main body part 10A. Also, a battery 15A is detachably mounted to a lower part of the handle part 11A. Also, the magazine 2A of the reinforcing bar binding machine 1A is provided in front of the handle part 11A. In the main body part 10A of the reinforcing bar binding machine 1A, the wire feeding unit 3A, the cutting unit 6A, the binding unit 7A, and the drive unit 8A configured to drive the binding unit 7A are accommodated.

Subsequently, an operation unit of the reinforcing bar binding machine 1A is described. A trigger 12A is provided on a front side of the handle part 11A of the reinforcing bar binding machine 1A, and a switch 13A is provided inside of the handle part 11A. The reinforcing bar binding machine 1A is configured so that a control unit 14A controls the motor 80 and the feeding motor (not shown), in accordance with a state of the switch 13A pressed as a result of an operation on the trigger 12A.

<Example of Operation of Reinforcing Bar Binding Machine>

FIGS. 11A to 11E illustrate an example of an operation of binding reinforcing bars with wires. In the below, an operation of binding the reinforcing bars S with the two wires W by the reinforcing bar binding machine 1A is described with reference to the drawings.

The reinforcing bar binding machine 1A is in a standby state in which the two wires W are sandwiched between the first feeding gear 30L and the second feeding gear 30R and the tip ends WS of the wires W are positioned from the sandwiched position between the first feeding gear 30L and the second feeding gear 30R to the fixed blade part 60 of the cutting unit 6A. Also, as shown in FIG. 10A, when the reinforcing bar binding machine 1A is in the standby state, the first movable engaging member 70L is opened with respect to the fixed engaging member 70C and the second movable engaging member 70R is opened with respect to the fixed engaging member 70C.

When the reinforcing bars S are inserted between the curl guide 50 and the inductive guide 51A of the curl forming unit 5A and the trigger 12A is operated, the feeding motor (not shown) is driven in the forward rotation direction, so that the first feeding gear 30L is rotated in the forward direction and the second feeding gear 30R is also rotated in the forward direction in conjunction with the first feeding gear 30L. Thereby, the two wires W sandwiched between the first feeding gear 30L and the second feeding gear 30R are fed in the forward direction denoted with the arrow F.

The first wire guide 4$A_1$ is provided upstream of the wire feeding unit 3A and the second wire guide 4$A_2$ is provided downstream of the wire feeding unit 3A with respect to the feeding direction of the wires W being fed in the forward direction by the wire feeding unit 3A, so that the two wires W are fed with being aligned in parallel along the axial direction of the loop Ru formed by the wires W.

When the wires W are fed in the forward direction, the wires W pass between the fixed engaging member 70C and the first movable engaging member 70L and pass through the guide groove 52 of the curl guide 50 of the curl forming unit 5A. Thereby, the wires W are curled to be wound around the reinforcing bars S at three points of the second wire guide 4$A_2$ and the first guide pin 53*a* and the third guide pin 53*c* of the curl guide 50 and at the second guide pin 53*b* upstream of the third guide pin 53*c*.

Figure 11A:
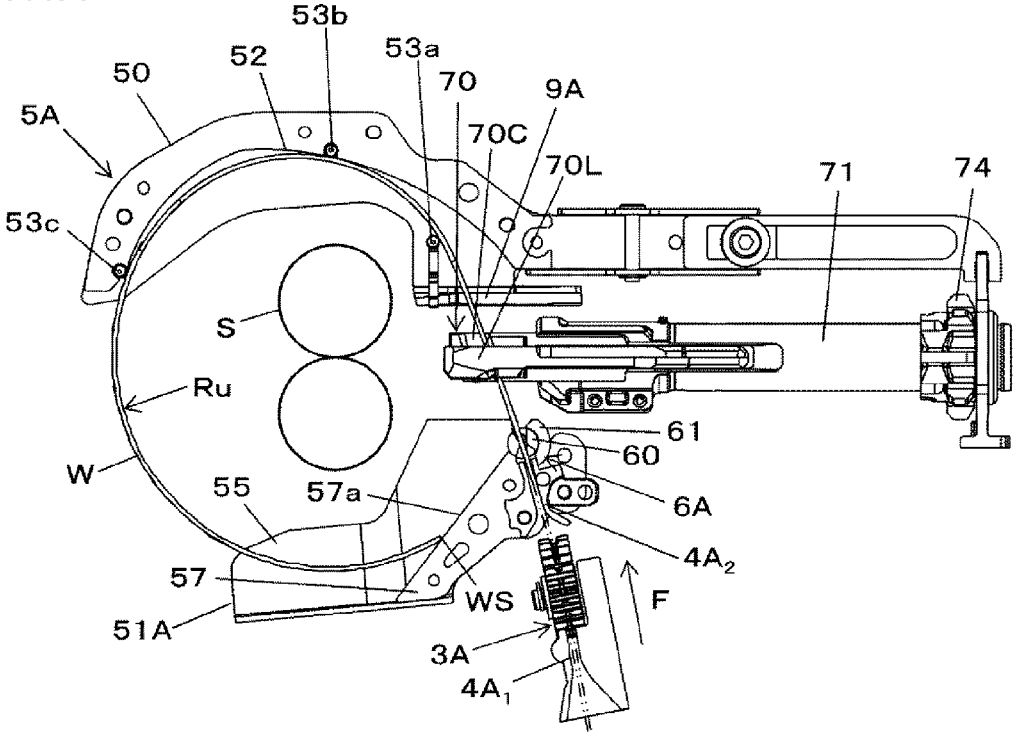
FIG. 11A illustrates an example of an operation of binding reinforcing bars with wires.

The wires W curled by the curl guide 50 are guided to the second guide part 57 by the first guide part 55 of the inductive guide 51A. As shown in FIG. 11A, the tip ends WS of the wires W guided to the second guide part 57 come into contact with the guide surface 57*a* of the second guide part 57. The wires W curled by the curl guide 50 are further fed in the forward direction by the wire feeding unit 3A, so that the wires are guided between the fixed engaging member 70C and the second movable engaging member 70R by the inductive guide 51A. The wires W are fed until the tip ends WS are butted to the feeding regulation unit 9A. When the wires W are fed to a position in which the tip ends WS are butted to the feeding regulation unit 9A, the drive of the feeding motor (not shown) is stopped.

Figure 11B:
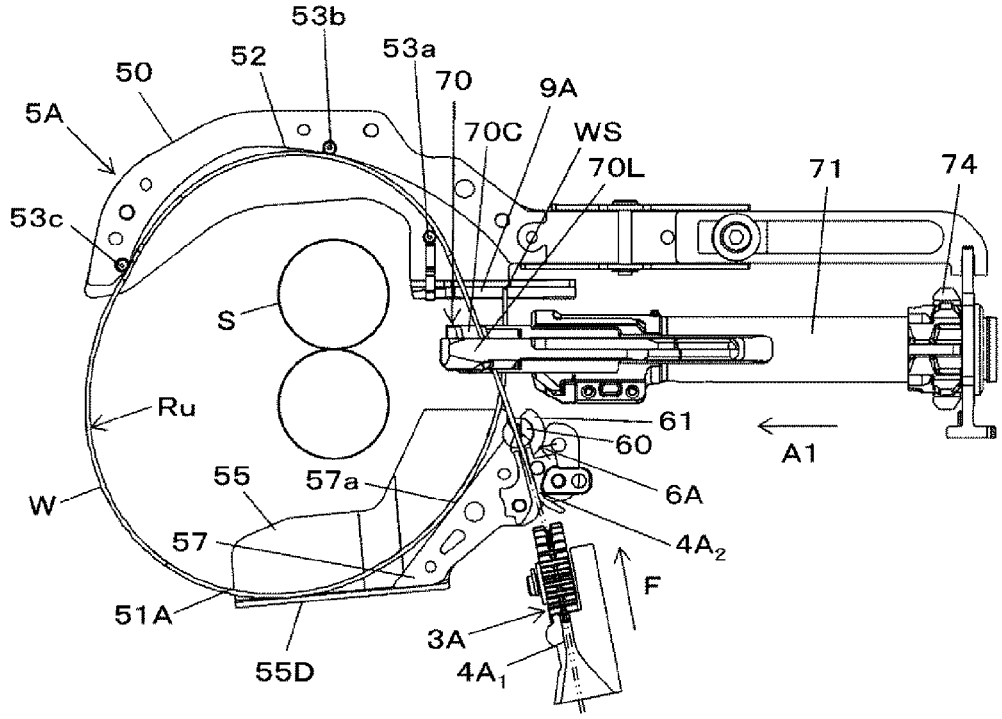
FIG. 11B illustrates an example of the operation of binding reinforcing bars with wires.

In the meantime, there is a slight time lag after the tip ends WS of the wires W come into contact with the feeding regulation unit 9A until the drive of the wire feeding unit 3A is stopped. Therefore, as shown in FIG. 11B, the loop Ru formed by the wires W is bent in a radially expanding direction until it comes into contact with the bottom surface part 55D of the first guide part 55 of the inductive guide 51A.

After the feeding of the wires W in the forward direction is stopped, the motor 80 is driven in the forward rotation direction. The rotating operation of the rotary shaft 72 of the actuating member 71 in conjunction with the rotation of the motor 80 is regulated by the rotation regulation part 74, so that the rotation of the motor 80 is converted into linear movement. Thereby, the actuating member 71 is moved in the forward direction denoted with the arrow A1.

When the actuating member 71 is moved in the forward direction, the opening/closing pin 71*a* passes through the opening/closing guide hole 73, as shown in FIG. 10B. Thereby, the first movable engaging member 70L is moved toward the fixed engaging member 70C by the rotating operation about the shaft 76 as a support point. When the first movable engaging member 70L is closed with respect to the fixed engaging member 70C, the wires W sandwiched between the first movable engaging member 70L and the fixed engaging member 70C are engaged in an aspect of capable of moving between the first movable engaging member 70L and the fixed engaging member 70C.

Also, the second movable engaging member 70R is moved toward the fixed engaging member 70C by the rotating operation about the shaft 76 as a support point. When the second movable engaging member 70R is closed with respect to the fixed engaging member 70C, the wires W sandwiched between the second movable engaging member 70R and the fixed engaging member 70C are engaged is such an aspect that the wires cannot come off between the second movable engaging member 70R and the fixed engaging member 70C.

Also, when the actuating member 71 is moved in the forward direction, the operation of the actuating member 71 is transmitted to the retraction mechanism 53, so that the first guide pin 53*a* is retracted.

After the actuating member 71 is advanced to a position in which the wires W are engaged by the closing operation of the first movable engaging member 70L and the second movable engaging member 70R, the rotation of the motor 80 is temporarily stopped and the feeding motor (not shown) is driven in the reverse rotation direction. Thereby, the first feeding gear 30L is reversed and the second feeding gear 30R is also reversed in conjunction with the first feeding gear 30L.

Figure 11C:
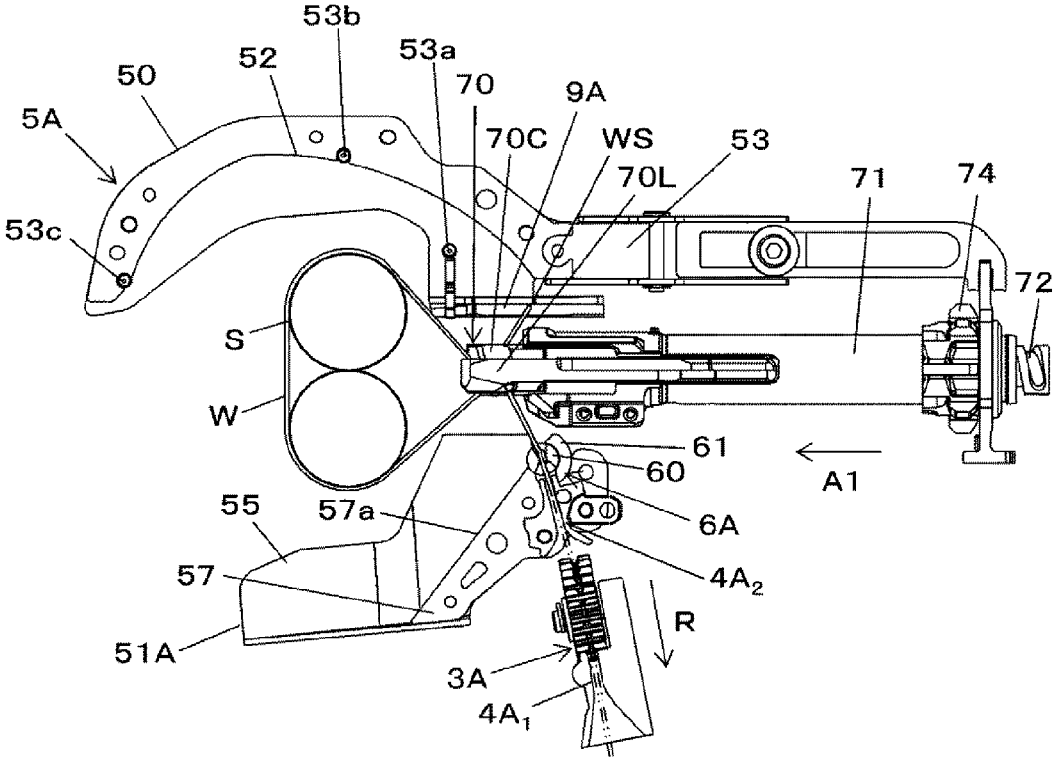
FIG. 11C illustrates an example of the operation of binding reinforcing bars with wires.

Therefore, the wires W sandwiched between the first feeding gear 30L and the second feeding gear 30R are fed in the reverse direction denoted with the arrow R. Since the tip ends WS of the wires W are engaged in such an aspect that the wires cannot come off between the second movable engaging member 70R and the fixed engaging member 70C, the wires W are wound with closely contacting the reinforcing bars S by the operation of feeding the wires W in the reverse direction, as shown in FIG. 11C.

After the wires W are wound on the reinforcing bars S and the drive of the feeding motor (not shown) in the reverse rotation direction is stopped, the motor 80 is driven in the forward rotation direction, so that the actuating member 71 is moved in the forward direction denoted with the arrow A1. The movement of the actuating member 71 in the forward direction is transmitted to the cutting unit 6A by the transmission mechanism 62, so that the movable blade part 61 is rotated and the wires W engaged by the first movable engaging member 70L and the fixed engaging member 70C are cut by the operation of the fixed blade part 60 and the movable blade part 61.

Figure 11D:
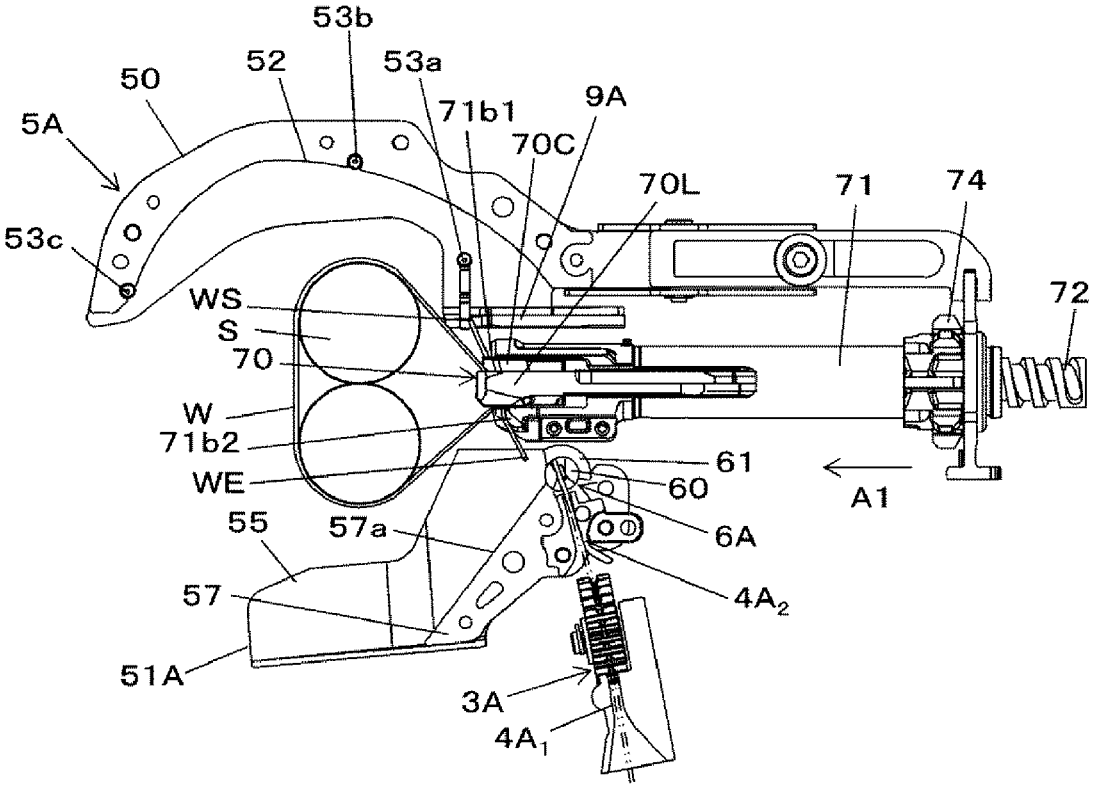
FIG. 11D illustrates an example of the operation of binding reinforcing bars with wires.

After the wires W are cut, the actuating member 71 is further moved in the forward direction, so that the bending parts 71*b*1 and 71*b*2 are moved toward the reinforcing bars S, as shown in FIG. 11D. Thereby, the tip ends WS of the wires W engaged by the fixed engaging member 70C and the second movable engaging member 70R are pressed toward the reinforcing bars S and bent toward the reinforcing bars S at the engaging position as a support point by the bending part 71*b*1. The actuating member 71 is further moved in the forward direction, so that the wires W engaged between the second movable engaging member 70R and the fixed engaging member 70C are maintained as being sandwiched by the bending part 71*b*1.

Also, the termination ends WE of the wires W engaged by the fixed engaging member 70C and the first movable engaging member 70L and cut by the cutting unit 6A are pressed toward the reinforcing bars S and are bent toward the reinforcing bars S at the engaging point as a support point by the bending part 71*b*2. The actuating member 71 is further moved in the forward direction, so that the wires W engaged between the first movable engaging member 70L and the fixed engaging member 70C are maintained as being sandwiched by the bending part 71*b*2.

After the tip ends WS and the termination ends WE of the wires W are bent toward the reinforcing bars S, the motor 80 is further driven in the forward rotation direction, so that the actuating member 71 is further moved in the forward direction. The actuating member 71 is moved to a predetermined position, so that the engaging by the rotation regulation part 74 is released.

Figure 11E:
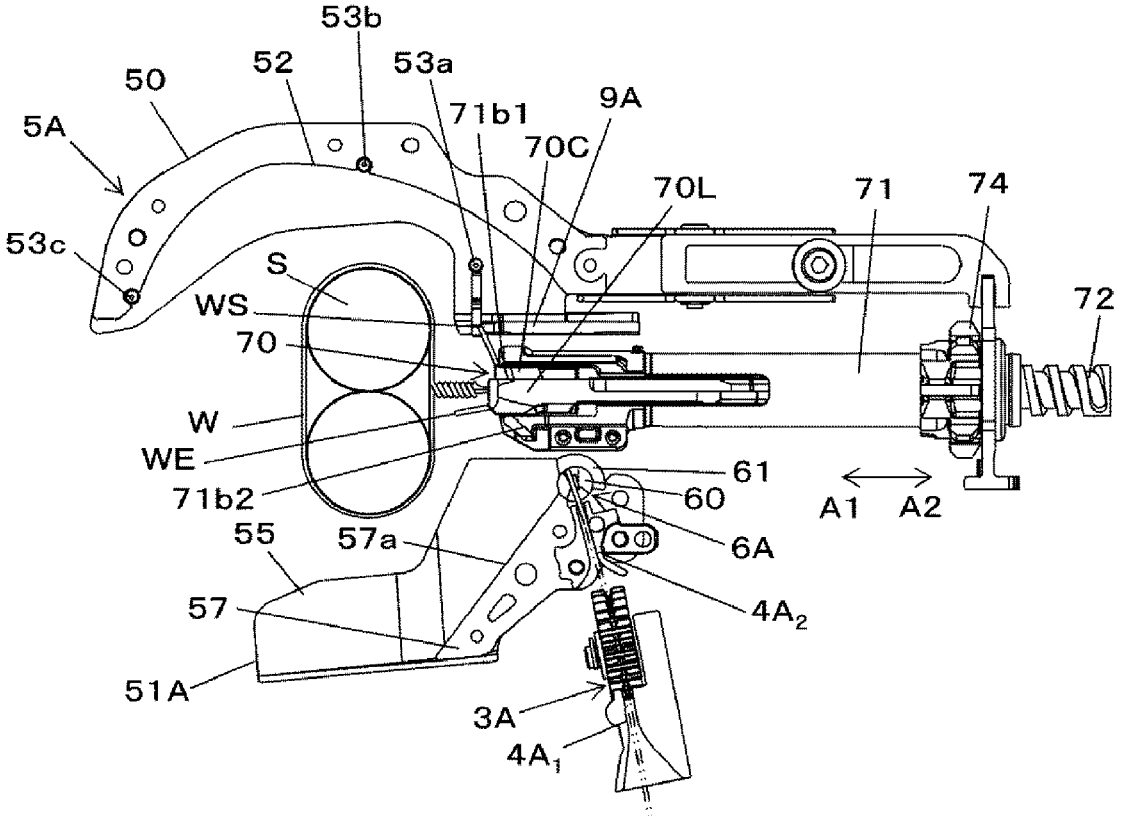
FIG. 11E illustrates an example of the operation of binding reinforcing bars with wires.

Thereby, the motor 80 is further driven in the forward rotation direction, so that the actuating member 71 is rotated in conjunction with the rotary shaft 72 and the engaging member 70 holding the wires W are rotated integrally with the actuating member 71, thereby twisting the wires W, as shown in FIG. 11E.

After the wires W are twisted, the motor 80 is driven in the reverse rotation direction. The rotating operation of the rotary shaft 72 of the actuating member 71 in conjunction with the rotation of the motor 80 is regulated by the rotation regulation part 74, so that the rotation of the motor 80 is converted into linear movement. Thereby, the actuating member 71 is moved in the backward direction denoted with the arrow A2.

When the actuating member 71 is moved in the backward direction, the bending parts 71*b* and 71*b*2 separate from the wires W, so that the holding state of the wires W by the bending parts 71*b*1 and 71*b*2 is released. Also, when the actuating member 71 moved in the backward direction, the opening/closing pin 71*a* passes through the opening/closing guide hole 73, as shown in FIG. 10A. Thereby, the first movable engaging member 70L is moved away from the fixed engaging member 70C by the rotating operation about the shaft 76 as a support point. Also, the second movable engaging member 70R is moved away from the fixed engaging member 70C by the rotating operation about the shaft 76 as a support point. Thereby, the wires W come off from the engaging member 70.

Figure 12A:
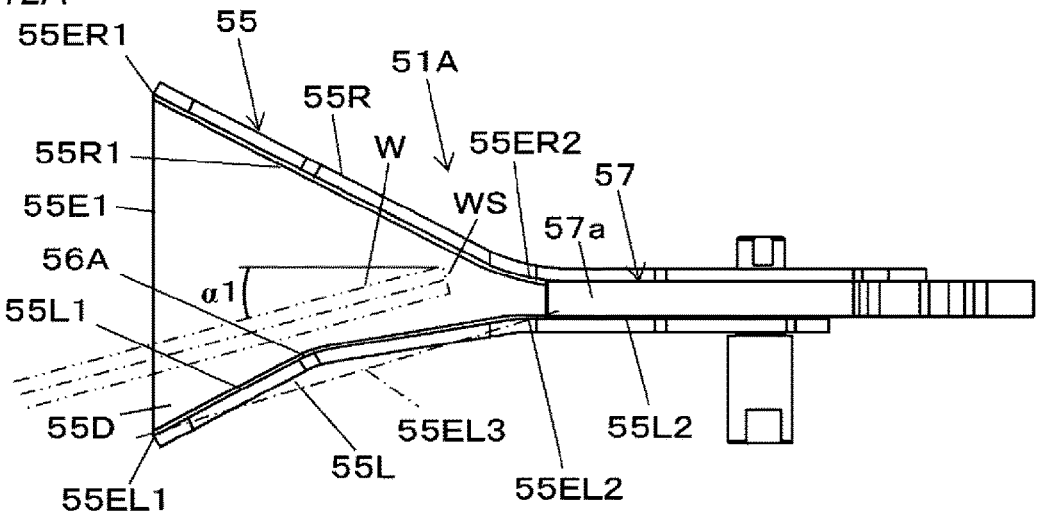
FIG. 12A illustrates movement of the wires in the inductive guide of the first embodiment.
Figure 12B:
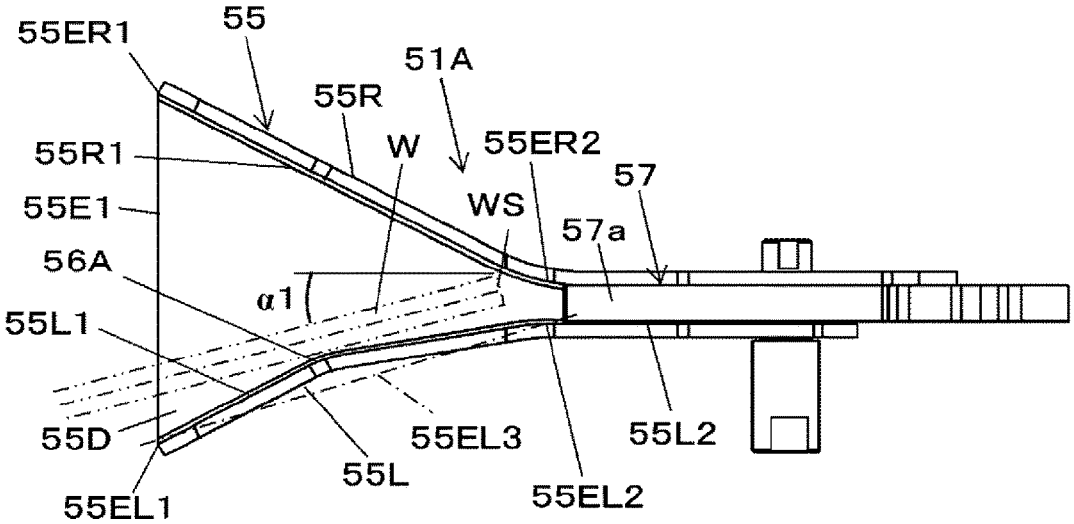
FIG. 12B illustrates movement of the wires in the inductive guide of the first embodiment.
Figure 12C:
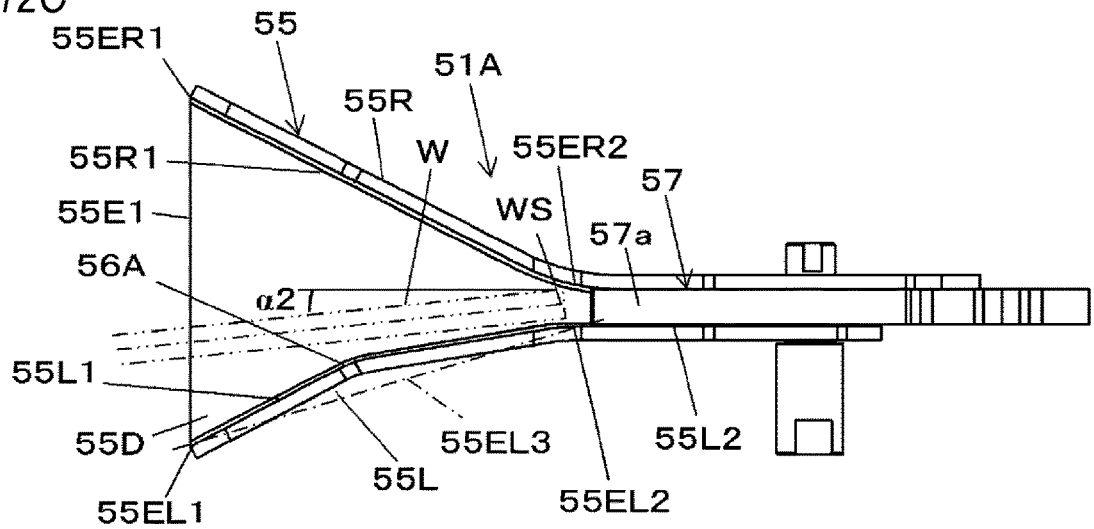
FIG. 12C illustrates movement of the wires in the inductive guide of the first embodiment.

FIGS. 12A, 12B and 12C illustrate movement of the wires in the inductive guide of the first embodiment. In the below, an operational effect of guiding the wires W by the inductive guide MA is described.

As described above, the wires W cured by the curl guide 50 are directed toward the other direction that is an opposite direction to one direction in which the reel 20 is offset. For this reason, in the inductive guide 51A, the wires W entering between the side surface part 55L and the side surface part 55R of the first guide part 55 are first introduced toward the third guiding part 55R1 of the side surface part 55R.

In the reinforcing bar binding machine of the related art, when it is assumed that a locus of wires curled to form a loop by the curl guide is a circle, a diameter thereof is about 50 to 70 mm. In contrast, according to the reinforcing bar binding machine 1A, when it is assumed that a locus of wires W curled to form the loop Ru by the curl guide 50 is an ellipse, a length in a long axis direction is about equal to or greater than 75 mm and equal to or less than 100 mm.

In this way, when the length in the long axis direction is about equal to or greater than 75 mm and equal to or less than 100 mm, on the assumption that the locus of wires W curled to form the loop Ru by the curl guide 50 is an ellipse, an entry angle $\alpha 1$ of the wires W entering toward the third guiding part 55R1 of the side surface part 55R increases, as compared to the reinforcing bar binding machine of the related art.

For this reason, when the tip ends WS of the wires W entering toward the third guiding part 55R1 of the side surface part 55R of the inductive guide 51A come into contact with the third guiding part 55R1, a resistance increases upon guiding of the tip ends WS of the wires W along the third guiding part 55R1. Therefore, a feeding defect that the wires W are not directed toward between the narrowest part 55EL2 of the first guiding part 55L1 and the narrowest part 55ER2 of the third guiding part 55R1 may occur.

Therefore, the entry angle regulation part 56A is provided to cause the tip ends of the wires W entering toward the third guiding part 55R1 of the side surface part 55R to be directed toward between the narrowest part 55EL2 of the first guiding part 55L1 and the narrowest part 55ER2 of the third guiding part 55R1.

That is, when the wires W entering between the side surface part 55L and the side surface part 55R of the first guide part 55 are introduced toward the third guiding part 55R1 of the side surface part 55R, the wires W at a part located between the side surface part 55L and the side surface part 55R come into contact with the entry angle regulation part 56A, as shown in FIG. 12B. When the wires W come into contact with the entry angle regulation part 56A, a force of rotating the wires W in a direction in which the tip ends WS of the wires W are caused to be directed toward between the narrowest part 55EL2 of the first guiding part 55L1 and the narrowest part 55ER2 of the third guiding part 55R1 is applied to the wires W with the entry angle regulation part 56A as a support point.

Thereby, as shown in FIG. 12C, an entry angle $\alpha 2$ of the wires W ($\alpha 2 < \alpha 1$) entering toward the third guiding part 55R1 of the side surface part 55R decreases and the tip ends WS of the wires W are directed toward between the narrowest part 55EL2 of the first guiding part 55L1 and the narrowest part 55ER2 of the third guiding part 55R1. Therefore, the wires W curled by the curl guide 50 can be introduced between the pair of second guiding part 55L2 and fourth guiding part 55R2 of the first guide part 55.

Figure 13A:
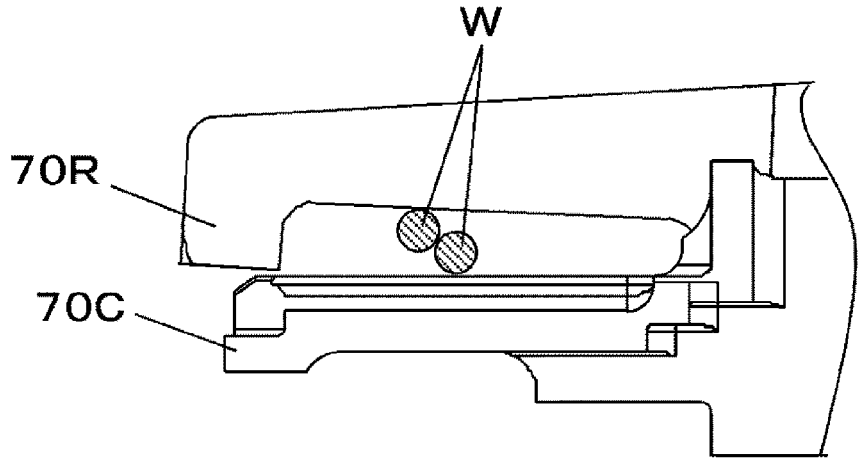
FIG. 13A illustrates an engaged state of the wires in an engaging member.
Figure 13B:
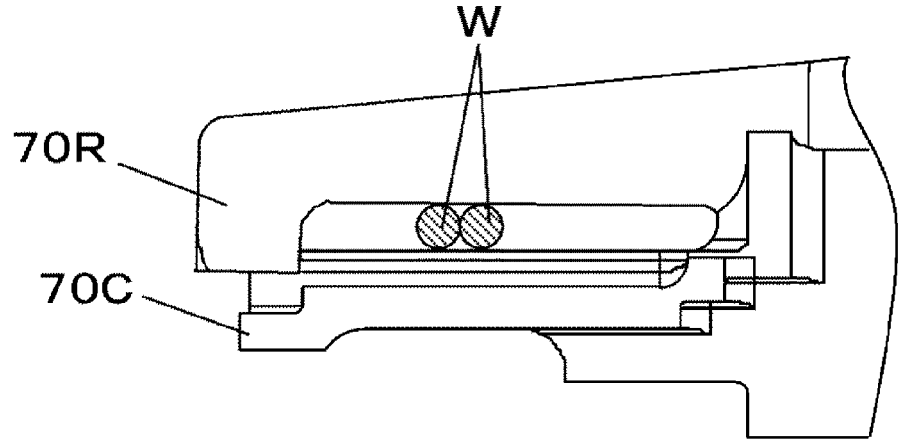
FIG. 13B illustrates an engaged state of the wires in the engaging member.
Figure 13C:
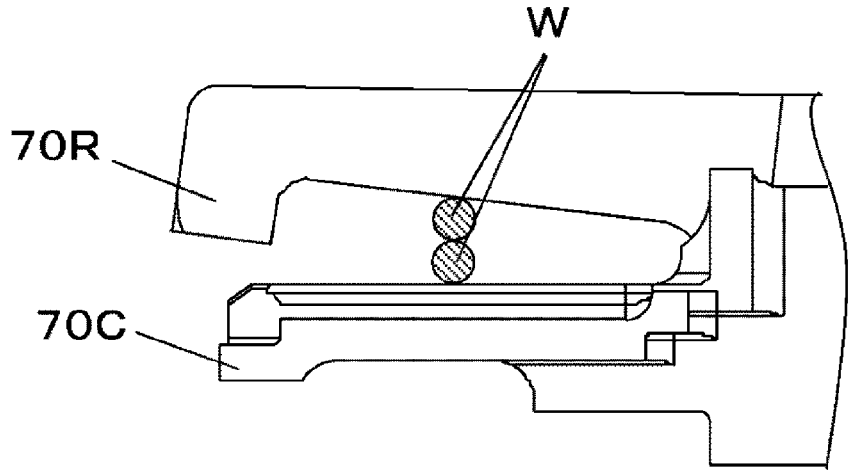
FIG. 13C illustrates an engaged state of the wires in the engaging member.

FIGS. 13A, 13B and 13C illustrate engaged state of the wires in the engaging member. In the below, when engaging the two wires W in the engaging member 70, an operational effect of guiding a parallel alignment direction of the two wires W is described.

In the reinforcing bar binding machine of the related art, the wires W are guided to the engaging member 70 of the binding unit 7A without the wires W contacting the guide surface 57*a* of the second guide part 57. In contrast, according to the reinforcing bar binding machine 1A, the wires W guided to the second guide part 57 by the first guiding part 55L1 and the third guiding part 55R1 of the first guide part 55 of the inductive guide 51A are contacted to the guide surface 57*a* and are thus guided to the engaging member 70 of the binding unit 7A, as shown in FIGS. 11A and 11B.

When the two wires W come into contact with the guide surface 57*a*, the wires W are guided between the fixed engaging member 70C and the second movable engaging member 70R in a state in which the parallel alignment direction of the two wires W is regulated by the guide surface 57*a*.

Since the guide surface 57*a* is planar, when the two wires W are fed with being in contact with the guide surface 57*a*, the two wires W are aligned in parallel in a direction following the axial direction of the loop Ru formed by the wires W.

For this reason, as shown in FIG. 13C, the two wires W are aligned in parallel along the direction in which the second movable engaging member 70R is opened/closed with respect to the fixed engaging member 70C, and the two wires W are engaged between the fixed engaging member 70C and the second movable engaging member 70R in a state in which an interval corresponding two wires is formed. Thereby, a load to be applied to the engaging member 70 increases.

Figure 14A:
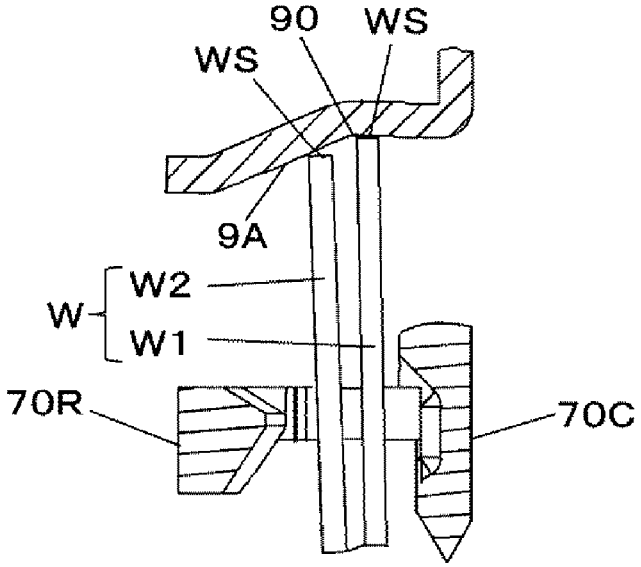
FIG. 14A illustrates movement of the wires in a feeding regulation unit.
Figure 14B:
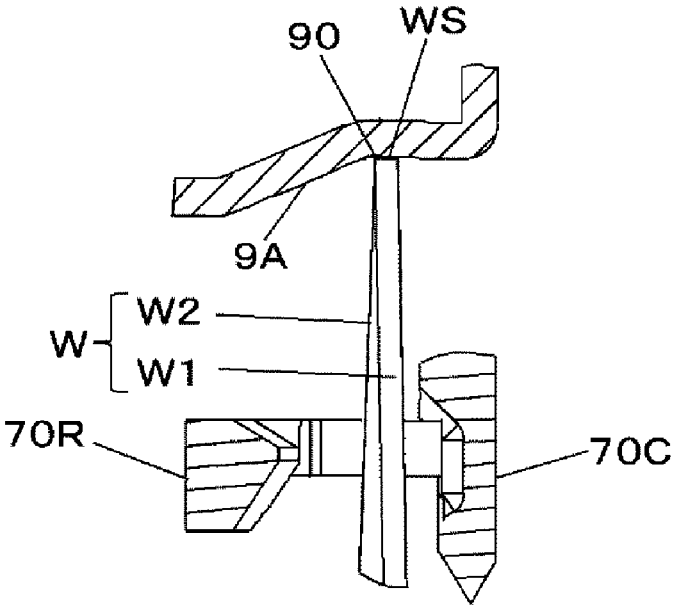
FIG. 14B illustrates movement of the wires in the feeding regulation unit.

Therefore, the parallel alignment direction of the two wires W is guided with the feeding regulation unit 9A. FIGS. 14A and 14B illustrate movement of the wires in the feeding regulation unit. In the below, an operational effect of guiding the wires W with the feeding regulation unit 9A is described.

The feeding regulation unit 9A has the parallel alignment regulation part 90 provided on a surface with which the wires W come into contact and extending in a direction intersecting with a parallel alignment direction of the two wires W to be regulated by the first wire guide $4A_1$ and the second wire guide $4A_2$.

The parallel alignment regulation part 90 has such a shape that it is concave in the feeding direction of the wires W being fed in the forward direction. Therefore, when the tip ends WS of the wires W are pressed to the feeding regulation unit 9A, the tip ends WS of the wires W are guided toward an apex of the concave portion configuring the parallel alignment regulation part 90.

Thereby, as shown in FIG. 14A, when the two wires W are fed in the forward direction until the tip ends WS of the two wires W having passed between the fixed engaging member 70C and the second movable engaging member 70R are contacted and pressed to the feeding regulation unit 9A, the tip ends WS of the two wires W are guided along the extension direction of the parallel alignment regulation part 90, as shown in FIG. 14B. Therefore, a direction in which the two wires W are aligned in parallel between the fixed engaging member 70C and the second movable engaging member 70R is guided to the radial direction of the loop Ru shown in FIG. 3.

For this reason, as shown in FIG. 13A, it is possible to guide the two wires W so that the wires are to be aligned in parallel in a direction intersecting with the opening/closing direction of the second movable engaging member 70R with respect to the fixed engaging member 70C. Therefore, as shown in FIG. 13B, the two wires W are engaged between the fixed engaging member 70C and the second movable engaging member 70R in such an aspect that an interval corresponding to one wire is formed therebetween. As a result, it is possible to reduce the load to be applied to the engaging member 70, thereby securing engaging the two wires W.

Figure 15A:
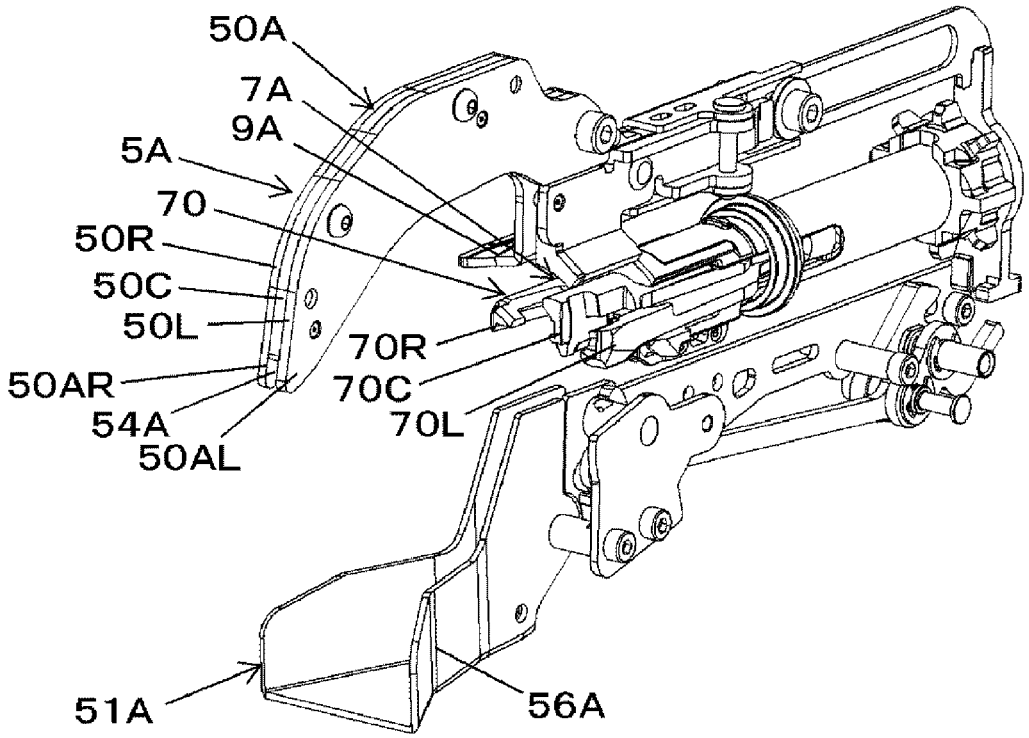
FIG. 15A is a perspective view of main parts depicting a curl guide of the first embodiment.
Figure 15B:
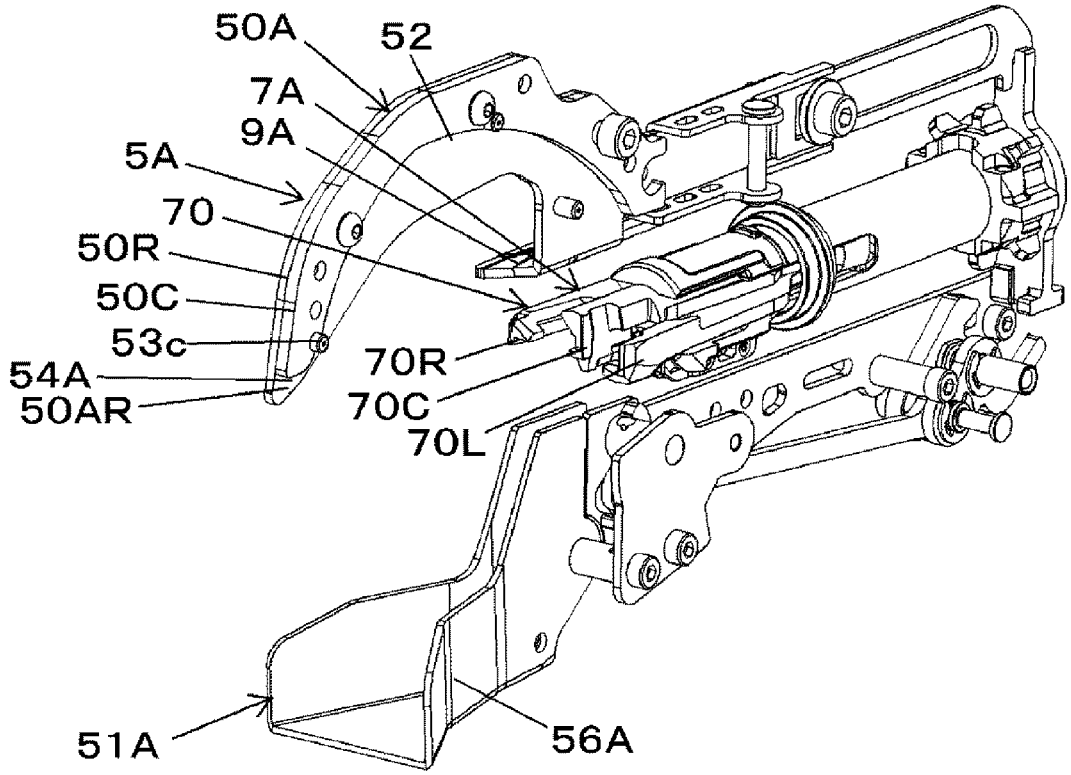
FIG. 15B is an exploded perspective view of main parts depicting the curl guide of the first embodiment.
Figure 15C:
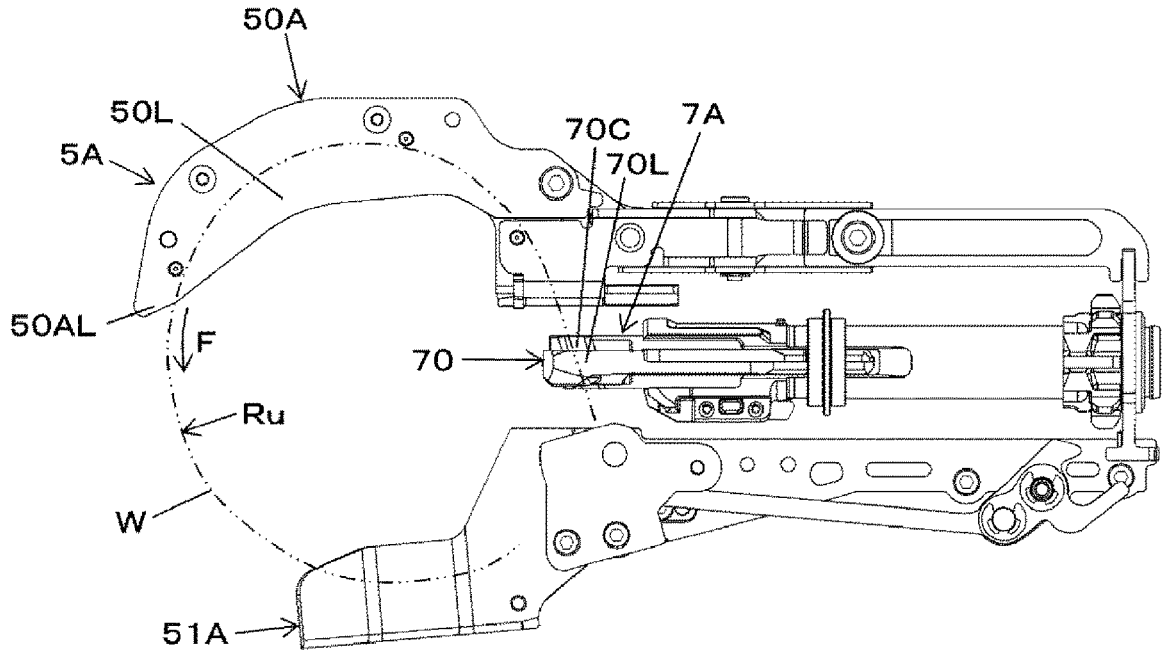
FIG. 15C is a side view of main parts depicting the curl guide of the first embodiment.
Figure 15D:
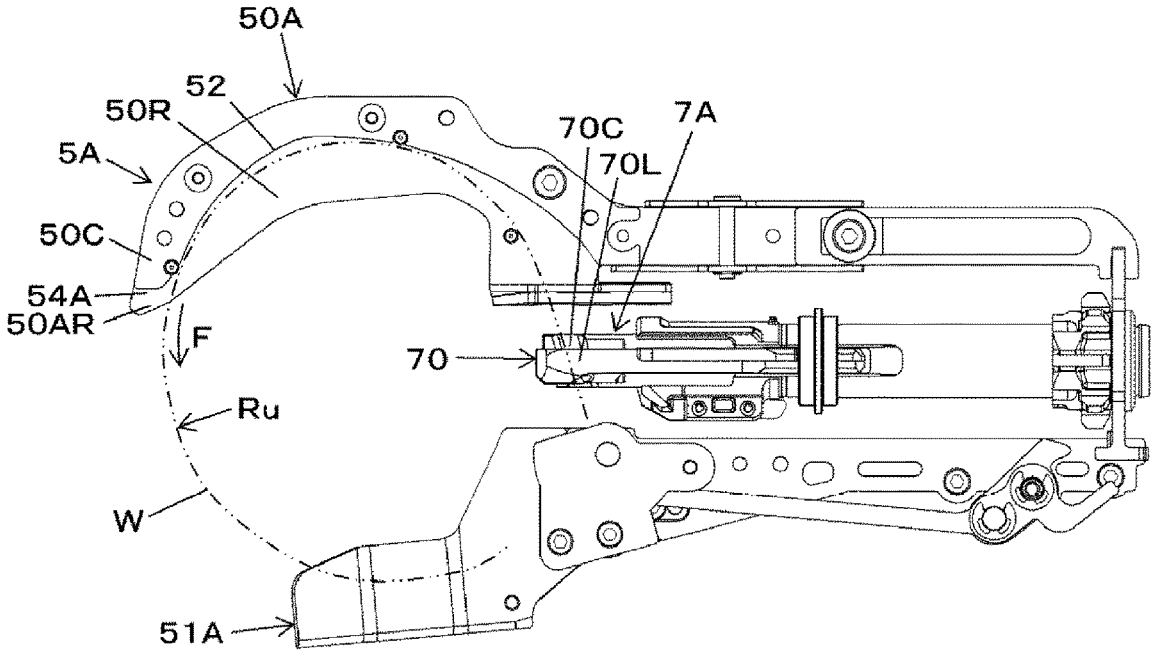
FIG. 15D is an exploded side view of main parts depicting the curl guide of the first embodiment.

FIG. 15A is a perspective view of main parts depicting a curl guide of the first embodiment, FIG. 15B is an exploded perspective view of main parts depicting the curl guide of the first embodiment, FIG. 15C is a side view of main parts depicting the curl guide of the first embodiment, and FIG. 15D is an exploded side view of main parts depicting the curl guide of the first embodiment.

In the curl guide 50, if the wires W are fed in a state in which there is an obstacle in a position in which it blocks the feeding path of the wires W formed by the guide groove 52, the wires W cannot be fed to a further forward side than the curl guide 50, so that a feeding trouble of the wires W may occur.

Therefore, the curl guide 50A of the first embodiment has a retraction guide part 54A configured to retract the wires W downstream of the engaging member 70 of the binding unit 7A with respect to the feeding of the wires W in the forward direction. The retraction guide part MA is provided to the curl guide 50A, and is configured to retract the wires W from the curl guide 50A downstream of the feeding path of the wires W formed between the fixed engaging member 70C and the first movable engaging member 70L configuring the engaging member 70.

The guide plate 50L located on one side part of the curl guide 50A has a convex part 50AL that further protrudes toward a downstream side with respect to the feeding of the wires W in the forward direction denoted with the arrow F than the guide plate 50C located at a center of the curl guide 50A. Also, the guide plate 50R located on the other side part of the curl guide 50A has a convex part 50AR that further protrudes toward a downstream side with respect to the feeding of the wires W in the forward direction than the guide plate 50C. The convex part 50AL of the guide plate 50L and the convex part 50AR of the guide plate 50R further protrude in the same upward direction than the guide plate 50C by a length greater than a diameter of one wire W.

The guide plate 50L and the guide plate 50R are inclined in a direction in which the convex part 50AL and the convex part 50AR further protrude than the guide plate 50C toward a radially outer side of the loop Ru to be formed by the wires W.

Thereby, the convex part 50AL of the guide plate 50L and the convex part 50AR of the guide plate 50R further protrude than the guide plate 50C toward the downstream side with respect to the feeding of the wires W in the forward direction.

Therefore, the retraction guide part MA is configured by providing a space, through which the wires W can pass toward the radially outer side of the loop Ru to be formed by the wires W, between the convex part 50AL of the guide plate 50L and the convex part 50AR of the guide plate 50R at a tip end of the curl guide 50A with respect to the feeding of the wires W in the forward direction.

Thereby, in the curl guide 50A, if the wires W are fed in a state in which there is an obstacle in a position in which it blocks the feeding path of the wires W formed by the guide groove 52, the wires W coming into contact with the obstacle passes through the retraction guide part 54A toward the radially outer side of the loop Ru to be formed by the wires W, and are then fed outside of the curl guide 50A. Therefore, occurrence of buckling and the like is suppressed, and even when a feeding trouble occurs, the wires W can be easily removed. Therefore, it is possible to suppress occurrence of a failure due to the feeding trouble of the wires W.

Figure 16A:
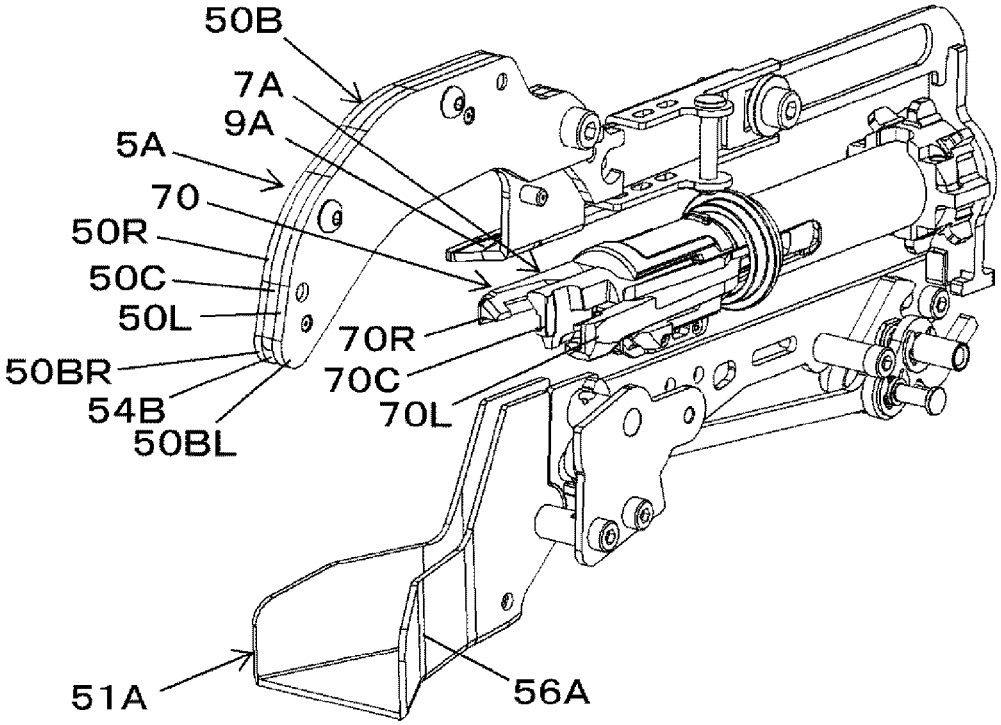
FIG. 16A is a perspective view of main parts depicting a curl guide of a second embodiment.
Figure 16B:
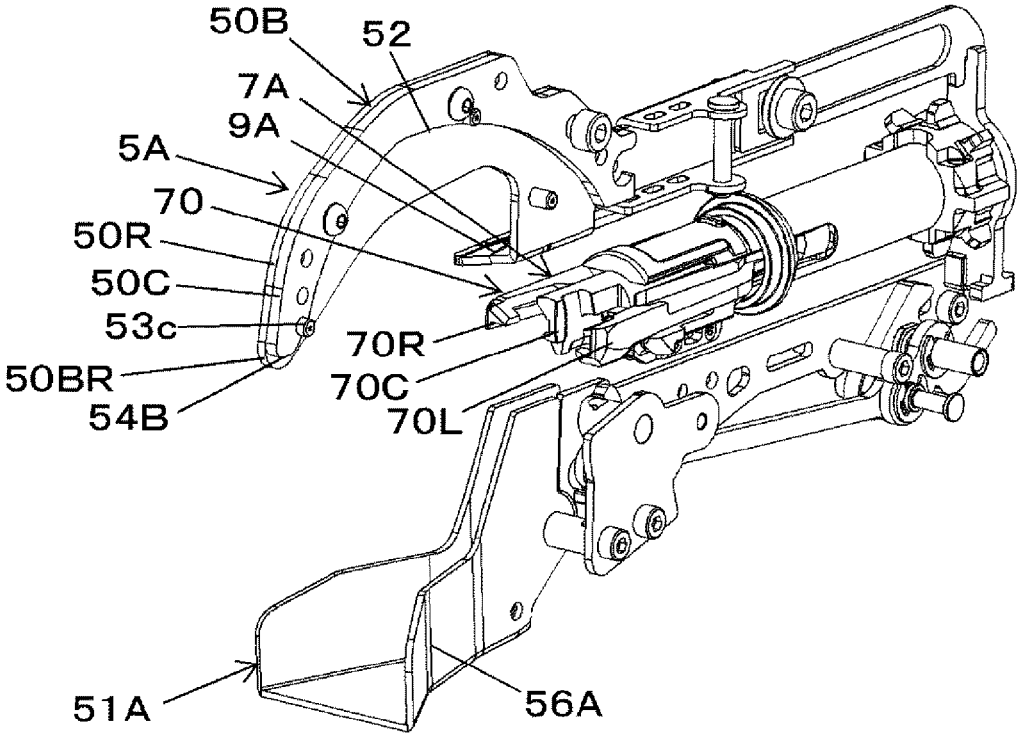
FIG. 16B is an exploded perspective view of main parts depicting the curl guide of the second embodiment.
Figure 16C:
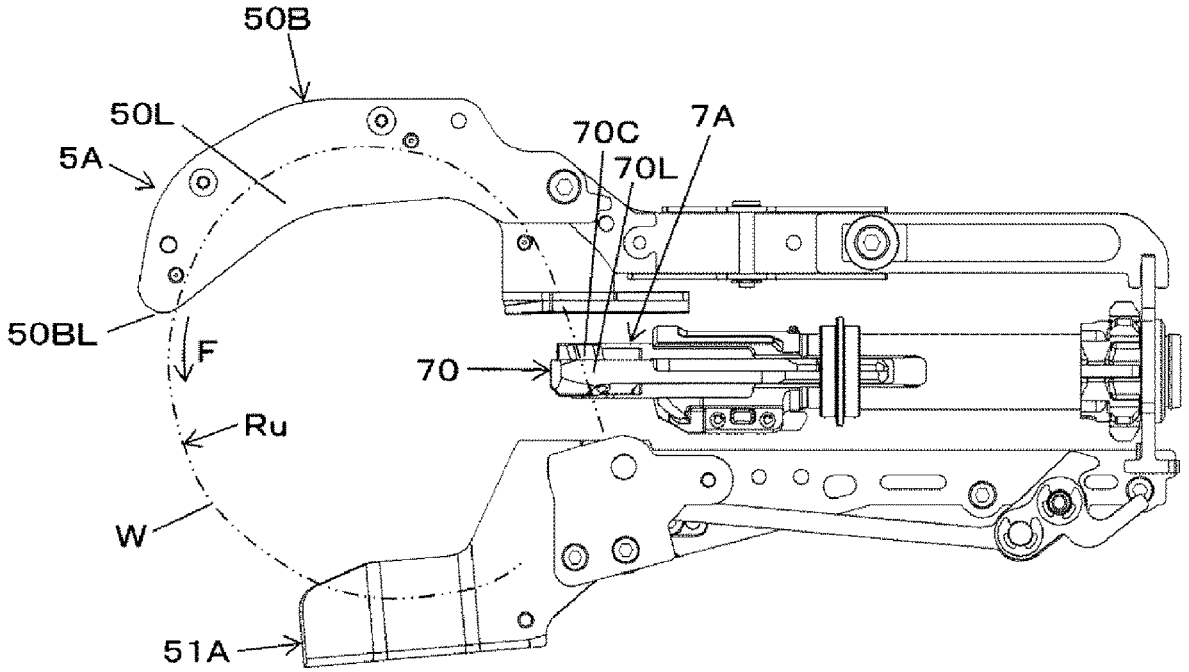
FIG. 16C is a side view of main parts depicting the curl guide of the second embodiment.
Figure 16D:
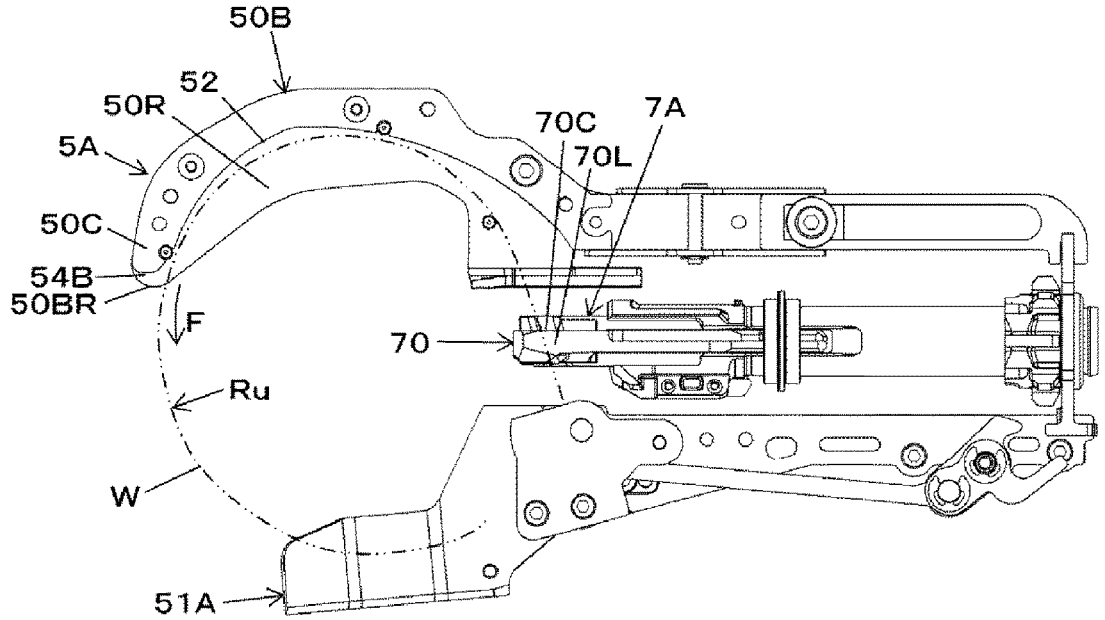
FIG. 16D is an exploded side view of main parts depicting the curl guide of the second embodiment.

FIG. 16A is a perspective view of main parts depicting a curl guide of a second embodiment, FIG. 16B is an exploded perspective view of main parts depicting the curl guide of the second embodiment, FIG. 16C is a side view of main parts depicting the curl guide of the second embodiment, and FIG. 16D is an exploded side view of main parts depicting the curl guide of the second embodiment. In a curl guide 50B of the second embodiment, the structures that are equivalent to those of the curl guide 50A of the first embodiment are denoted with the same reference signs, and the detailed descriptions thereof are omitted.

The curl guide 50B of the second embodiment has a retraction guide part MB configured to retract the wires W downstream of the engaging member 70 of the binding unit 7A with respect to the feeding of the wires W in the forward direction. The retraction guide part MB is provided to the curl guide 50B, and is configured to retract the wires W from the curl guide 50B downstream of the feeding path of the wires W formed between the fixed engaging member 70C and the first movable engaging member 70L configuring the engaging member 70.

The guide plate 50L located on one side part of the curl guide 50B has a convex part 50BL that further protrudes toward a downstream side with respect to the feeding of the wires W in the forward direction denoted with the arrow F than the guide plate 50C located at a center of the curl guide 50B. Also, the guide plate 50R located on the other side part of the curl guide 50B has a convex part 50BR that further protrudes toward a downstream side with respect to the feeding of the wires W in the forward direction than the guide plate 50C. The convex part 50BL of the guide plate 50L and the convex part 50BR of the guide plate 50R further protrude in the same upward direction than the guide plate 50C by a length greater than a diameter of one wire W.

The convex part 50BL of the guide plate 50L and the convex part 50BR of the guide plate 50R further protrude in a semicircular shape than the guide plate 50C toward the downstream side with respect to the feeding of the wires W in the forward direction.

Thereby, the convex part 50BL of the guide plate 50L and the convex part 50BR of the guide plate 50R further protrude than the guide plate 50C toward the downstream side with respect to the feeding of the wires W in the forward direction.

Therefore, the retraction guide part MB is configured by providing a space, through which the wires W can pass toward the radially outer side of the loop Ru to be formed by the wires W, between the convex part 50BL of the guide plate 50L and the convex part 50BR of the guide plate 50R at a tip end of the curl guide 50B with respect to the feeding of the wires W in the forward direction.

Thereby, in the curl guide 50B, if the wires W are fed in a state in which there is an obstacle in a position in which it blocks the feeding path of the wires W formed by the guide groove 52, the wires W coming into contact with the obstacle passes through the retraction guide part 54B toward the radially outer side of the loop Ru to be formed by the wires W, and are then fed outside of the curl guide 50B. Therefore, occurrence of buckling and the like is suppressed, and even when a feeding trouble occurs, the wires W can be easily removed. Therefore, it is possible to suppress occurrence of a failure due to the feeding trouble of the wires W.

Figure 17A:
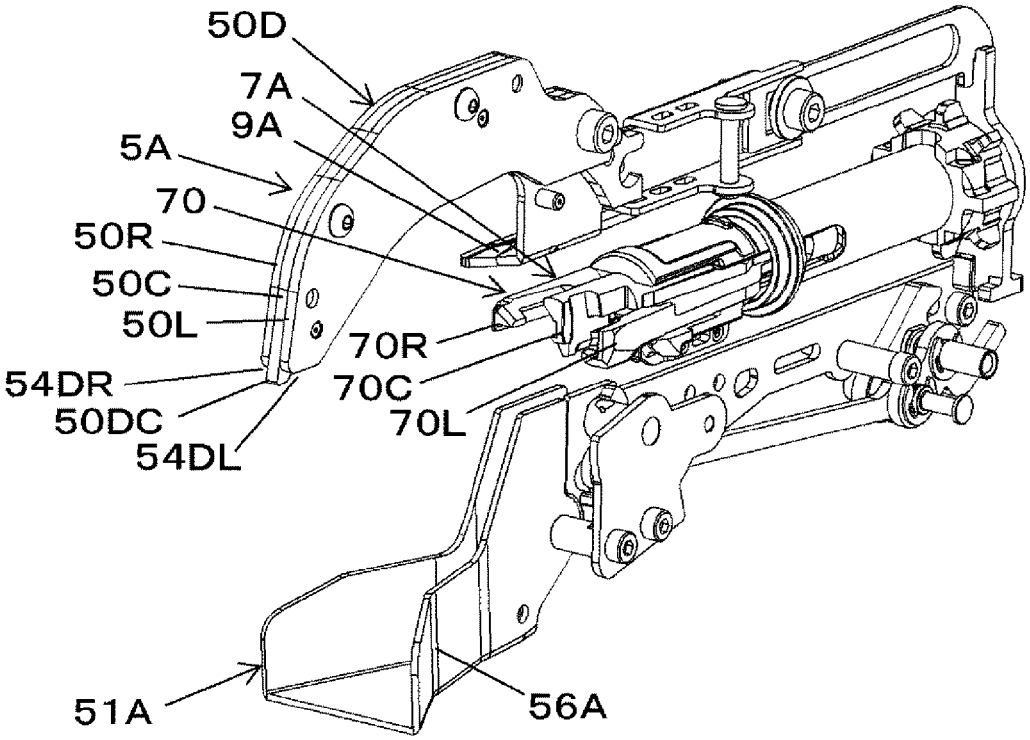
FIG. 17A is a perspective view of main parts depicting a curl guide of a third embodiment.
Figure 17B:
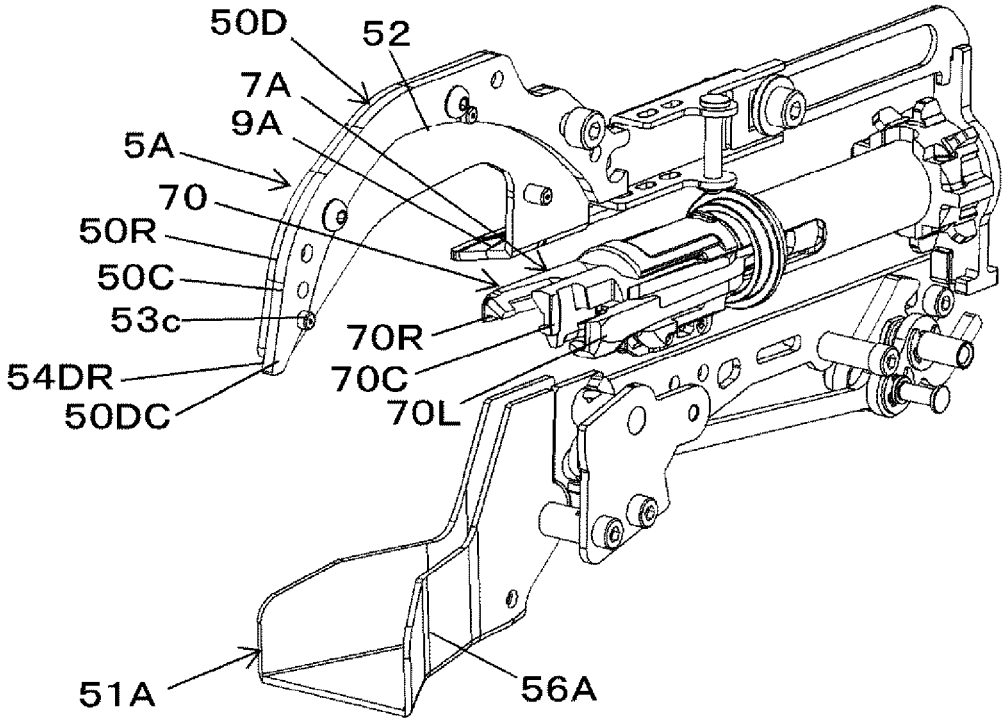
FIG. 17B is an exploded perspective view of main parts depicting the curl guide of the third embodiment.
Figure 17C:
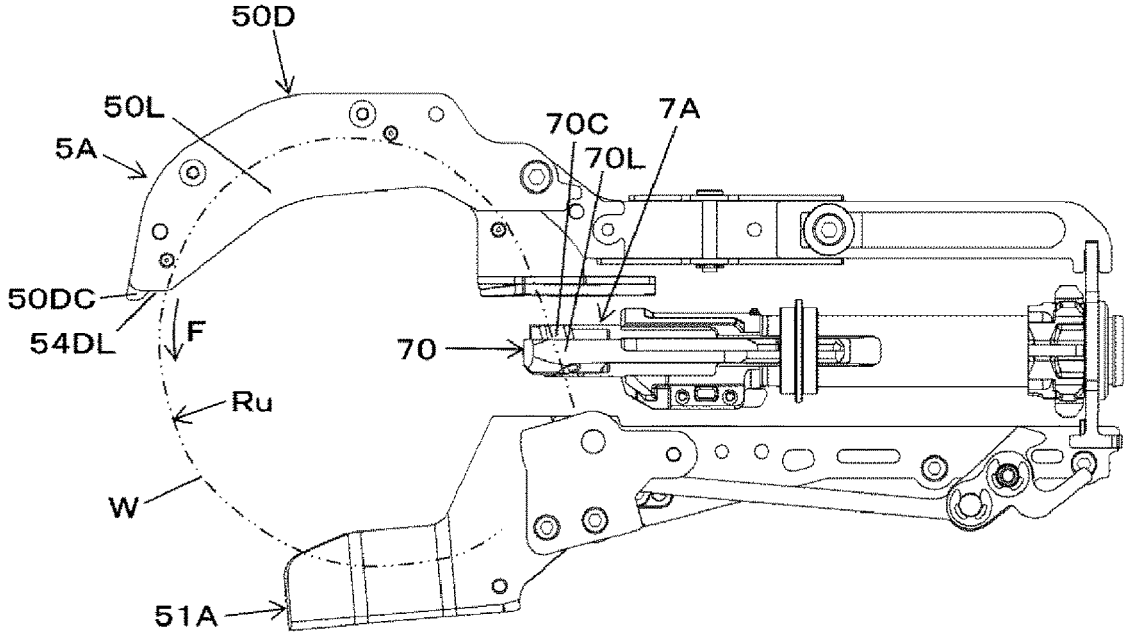
FIG. 17C is a side view of main parts depicting the curl guide of the third embodiment.
Figure 17D:
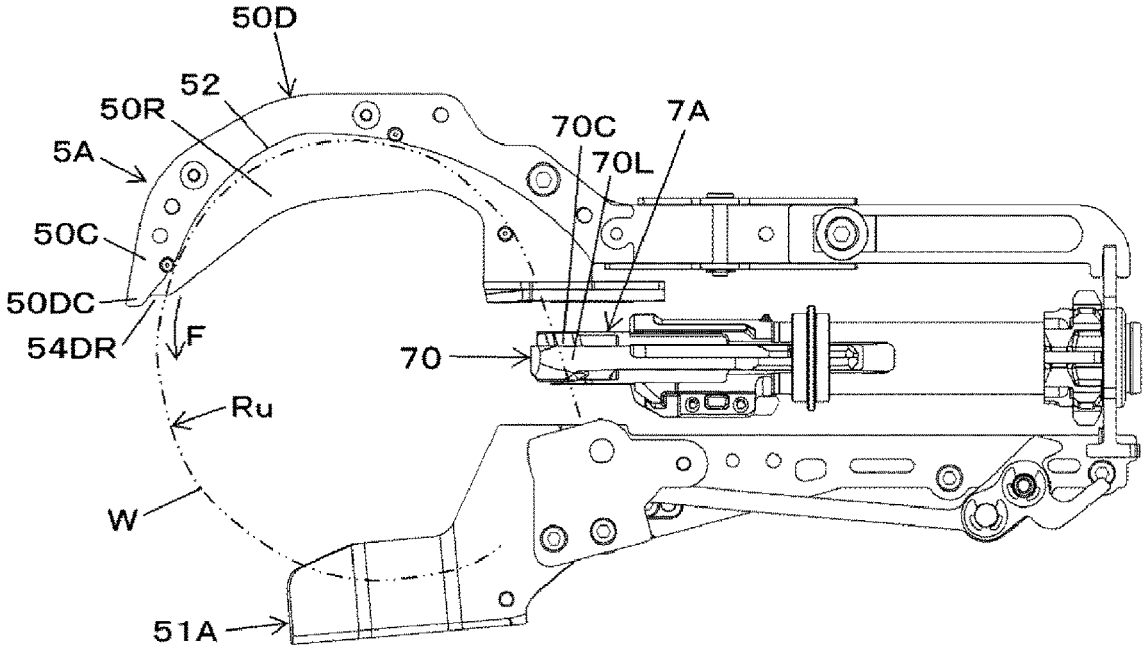
FIG. 17D is an exploded side view of main parts depicting the curl guide of the third embodiment.

FIG. 17A is a perspective view of main parts depicting a curl guide of a third embodiment, FIG. 17B is an exploded perspective view of main parts depicting the curl guide of the third embodiment, FIG. 17C is a side view of main parts depicting the curl guide of the third embodiment, and FIG. 17D is an exploded side view of main parts depicting the curl guide of the third embodiment. In a curl guide 50D of the third embodiment, the structures that are equivalent to those of the curl guide 50A of the first embodiment are denoted with the same reference signs, and the detailed descriptions thereof are omitted.

A curl guide 50D of the third embodiment has retraction guide parts 54DL and 54DR configured to retract the wires W downstream of the engaging member 70 of the binding unit 7A with respect to the feeding of the wires W in the forward direction. The retraction guide parts 54DL and 54DR are provided to the curl guide 50D, and are configured to retract the wires W from the curl guide 50D downstream of the feeding path of the wires W formed between the fixed engaging member 70C and the first movable engaging member 70L configuring the engaging member 70.

The guide plate 50C located between the guide plates 50L and 50R and also located at a center of the curl guide 50D has a convex part 50DC that further protrudes toward a downstream side with respect to the feeding of the wires W in the forward direction denoted with the arrow F than the guide plates 50L and 50R. The convex part 50DC of the guide plate 50C further protrudes in the same upward direction than the guide plates 50L and 50R by a length greater than a diameter of one wire W.

The guide plate 50C is inclined in a direction in which the convex part 50DC further protrudes than the guide plates 50L and 50R toward the radially outer side of the loop Ru to be formed by the wires W.

Thereby, the convex part 50DC of the guide plate 50C further protrudes than the guide plates 50L and 50R toward the downstream side with respect to the feeding of the wires W in the forward direction.

Therefore, the retraction guide part 54DL is configured by providing a space, through which the wires W can pass toward an axially outer side of the loop Ru to be formed by the wires W, on the guide plate 50L-side with respect to the convex part 50DC of the guide plate 50C at a tip end of the curl guide 50D with respect to the feeding of the wires W in the forward direction. Also, the retraction guide part 54DR is configured by providing a space, through which the wires W can pass toward the axially outer side of the loop Ru to be formed by the wires W, on the guide plate 50R-side with respect to the convex part 50DC of the guide plate 50C at a tip end of the curl guide 50D with respect to the feeding of the wires W in the forward direction.

Thereby, in the curl guide 50D, if the wires W are fed in a state in which there is an obstacle in a position in which it blocks the feeding path of the wires W formed by the guide groove 52, the wires W coming into contact with the obstacle passes through the retraction guide part 54DL or the retraction guide part 54DR toward the axially outer side of the loop Ru to be formed by the wires W, and are then fed outside of the curl guide 50D. Therefore, occurrence of buckling and the like is suppressed, and even when a feeding trouble occurs, the wires W can be easily removed. Therefore, it is possible to suppress occurrence of a failure due to the feeding trouble of the wires W.

Figure 18:
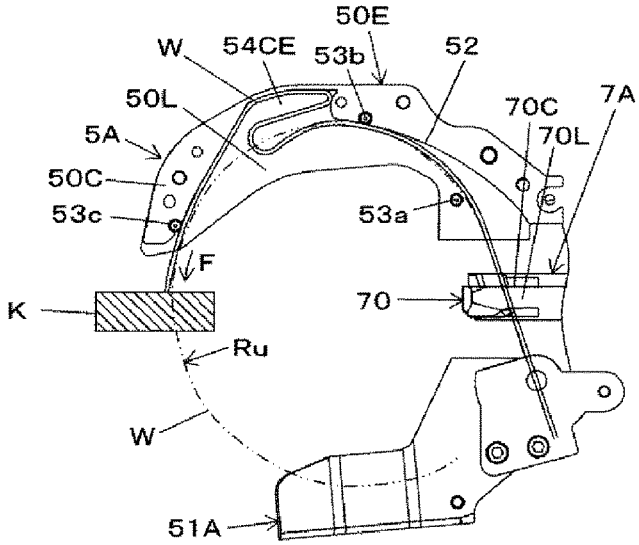
FIG. 18 is an exploded side view of main parts depicting a curl guide of a fourth embodiment.

FIG. 18 is an exploded side view of main parts depicting a curl guide of a fourth embodiment. In a curl guide 50E of the fourth embodiment, the structures that are equivalent to those of the curl guide 50A of the first embodiment are denoted with the same reference signs, and the detailed descriptions thereof are omitted.

The curl guide 50E of the fourth embodiment has a retraction guide part 54CE configured to retract the wires W from the curl guide 50E downstream of the engaging member 70 of the binding unit 7A with respect to the feeding of the wires W in the forward direction, specifically, downstream of the feeding path of the wires W formed between the fixed engaging member 70C and the first movable engaging member 70L configuring the engaging member 70.

The retraction guide part 54CE is configured by providing the guide plate 50C located at a center of the curl guide 50E with a concave part that is widened from the guide groove 52 in a radial direction of the loop Ru to be formed by the wires W. The retraction guide part 54CE is provided upstream of the third guide pin 53*c*. In a structure in which the second guide pin 53*b* is provided, the retraction guide part 54CE is provided between the second guide pin 53*b* and the third guide pin 53*c* upstream of the third guide pin 53*c*.

Thereby, in the curl guide 50E, if the wires W are fed in a state in which there is an obstacle K in a position in which it blocks the feeding path of the wires W formed by the guide groove 52, the wires W coming into contact with the obstacle is bent further downwardly than the first guide pin 53*a* toward the radially outer side of the loop Ru to be formed by the wires W and are then introduced into the retraction guide part 54CE. Therefore, it is possible to suppress occurrence of a failure due to the feeding trouble of the wires W.

Figure 19:
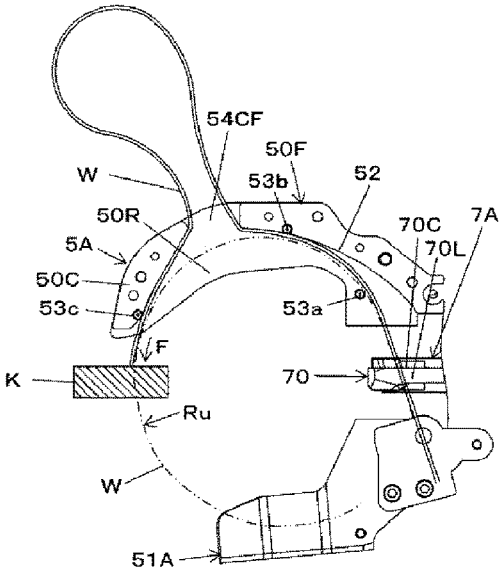
FIG. 19 is an exploded side view of main parts depicting a curl guide of a fifth embodiment.

FIG. 19 is an exploded side view of main parts depicting a curl guide of a fifth embodiment. In a curl guide 50F of the fifth embodiment, the structures that are equivalent to those of the curl guide 50A of the first embodiment are denoted with the same reference signs, and the detailed descriptions thereof are omitted.

The curl guide 50F of the fifth embodiment has a retraction guide part 54CF configured to retract the wires W from the curl guide 50F downstream of the engaging member 70 of the binding unit 7A with respect to the feeding of the wires W in the forward direction, specifically, downstream of the feeding path of the wires W formed between the fixed engaging member 70C and the first movable engaging member 70L configuring the engaging member 70.

The retraction guide part 54CF is configured by providing the guide plate 50C located at a center of the curl guide 50F with a hole portion expanding from the guide groove 52 in the radial direction of the loop Ru to be formed by the wires W and penetrating the guide plate 50C. The retraction guide part 54CF is provided upstream of the third guide pin 53*c*, and is configured to communicate with an outside of the curl guide 50E toward the radially outer side of the loop Ru to be formed by the wires W. In a structure in which the second guide pin 53*b* is provided, the retraction guide part 54CF is provided between the second guide pin 53*b* and the third guide pin 53*c* upstream of the third guide pin 53*c*, and communicates with an outside of the curl guide 50E toward the radially outer side of the loop Ru to be formed by the wires W.

Thereby, in the curl guide 50F, if the wires W are fed in a state in which there is an obstacle K in a position in which it blocks the feeding path of the wires W formed by the guide groove 52, the wires W coming into contact with the obstacle is bent further downwardly than the first guide pin 53*a* toward the radially outer side of the loop Ru to be formed by the wires W, are introduced into the retraction guide part 54CF and are then fed outside of the curl guide 50F. Therefore, it is possible to suppress occurrence of a failure due to the feeding trouble of the wires W.

Figure 20:
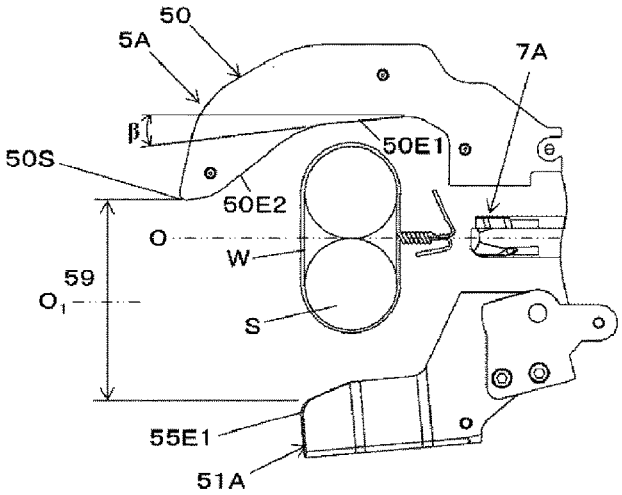
FIG. 20 illustrates an operation of extracting reinforcing bars from a curl forming unit.

FIG. 20 illustrates an operation of extracting reinforcing bars from the curl forming unit. In the reinforcing bar binding machine 1A, in the curl guide 50 configuring the curl forming unit 5A, a space between the tip end 50S of the curl guide 50 with respect to the feeding of the wires W in the forward direction and the opening end portion 55E1 of the introduction guide 51A becomes an insertion/extraction opening 59 of the reinforcing bars S. The insertion/extraction opening 59 is formed so that a center $O_1$ between the tip end 50S of the curl guide 50 and the opening end portion 55E1 of the introduction guide 51A is offset toward the inductive guide 51A-side with respect to a binding axis O that is a center of rotation of the binding unit 7A.

The inductive guide 51A is configured so that a part facing the curl guide 50 is inclined away from the curl guide 50 with respect to the binding axis O as it faces toward the insertion/extraction opening 59. In the meantime, the curl guide 50 is also provided with a first discharge guide surface 50E1 that is provided at a part facing the inductive guide 51A and is inclined by a predetermined angle β in a direction coming closer to the inductive guide 51A with respect to the binding axis O as it faces toward the insertion/extraction opening 59, i.e., in an offset direction of the insertion/extraction opening 59. Also, a second discharge guide surface 50E2 interconnecting the first discharge guide surface 50E1 and the insertion/extraction opening 59 is provided.

Thereby, in an operation of extracting the reinforcing bars S bound with the wires W from the curl forming unit 5A, even when the reinforcing bars S come into contact with the curl guide 50, the reinforcing bars S are guided to the second discharge guide surface 50E2 along an inclination of the first discharge guide surface 50E1 and are extracted from the insertion/extraction opening 59.

REFERENCE SIGNS LIST

1A . . . reinforcing bar binding machine, 10A . . . main body part, 2A . . . magazine (accommodation unit), 20 . . . reel, 21 . . . hub part, 22, 23 . . . flange part, 3A . . . wire feeding unit, 30L . . . first feeding gear (feeding member), 31L . . . tooth part, 32L . . . groove portion, 30R . . . second feeding gear (feeding member), 31R . . . tooth part, 32R . . . groove portion, 36 . . . first displacement member, 37 . . . second displacement member, 38 . . . spring, 4$A_1$ . . . first wire guide, 4$A_2$ . . . second wire guide, 5A . . . curl forming unit, 50, 50A, 50B, 50C, 50D, 50E, 50F . . . curl guide, 50AL, SOAR, 50BL, 50BR, 50DC . . . convex part, 50S . . . tip end, 50E1 . . . first discharge guide surface, 50E2 . . . second discharge guide surface, 51A . . . inductive guide, 52 . . . guide groove, 53 . . . retraction mechanism, 53*a* . . . first guide pin, 53*b* . . . second guide pin, 53*c* . . . third guide pin, MA, MB, MDL, 54DR, 54CE, 54CF . . . retraction guide groove, 55 . . . first guide part, 55L . . . side surface part, 55R . . . side surface part, 55D . . . bottom surface part, 55L1 . . . first guiding part, 55L2 . . . second guiding part, 55R1 . . . third guiding part, 55R2 . . . fourth guiding part, 55S . . . converging passage, 55E1 . . . opening end portion, 55E2 . . . narrowest part, 55EL1 . . . opening end portion, 55ER1 . . . opening end portion, 55EL2 . . . narrowest part, 55ER2 . . . narrowest part, 55EL3 . . . virtual line, 56A . . . entry angle regulation part, 57 . . . second guide part, 57*a* . . . guide surface, 59 . . . insertion/extraction opening, 6A . . . cutting unit, 60 . . . fixed blade part, 61 . . . movable blade part, 62 . . . transmission mechanism, 7A . . . binding unit, 70 . . . engaging member, 70L . . . first movable engaging member, 70R . . . second movable engaging member, 70C . . . fixed engaging member, 71 . . . actuating member, 71*a* . . . opening/closing pin, 71*b*1 . . . bending part, 71*b*2 . . . bending part, 72 . . . rotary shaft, 73 . . . opening/closing guide hole, 74 . . . rotation regulation part, 8A . . . drive unit, 80 . . . motor, 81 . . . decelerator, 9A . . . feeding regulation unit, 90 . . . parallel alignment regulation part, W . . . wire

The invention claimed is:

1. A binding machine comprising:

a wire feeding unit configured to feed, on a wire feeding path, a wire to be wound on an object to be bound;

a binding unit configured to twist the wire wound on the object to be bound;

a curl guide configured to curl, on the wire feeding path, the wire being fed by the wire feeding unit, the curl guide including (i) a first guide plate, (ii) a second guide plate, and (iii) a third guide plate located between the first and second guide plates, the third guide plate protruding further than the first and second guide plates toward a downstream side with respect to a feeding direction of the wire that is fed by the wire feeding unit in a direction of curling the wire by the curl guide;

an inductive guide configured to guide, on the wire feeding path, the wire curled by the curl guide toward the binding unit; and a retraction guide part configured to retract the wire to a position that is (i) downstream of the binding unit and (ii) in a direction offset from the feeding direction of the wire that is fed by the wire feeding unit, wherein the retraction guide part is located on the binding machine at a position that is external to the wire feeding path, and wherein the retraction guide part is provided between the first and second guide plates on both sides of the third guide plate.

2. The binding machine according to claim 1, wherein the retraction guide part is provided to the curl guide.

3. The binding machine according to claim 1, wherein the retraction guide part is provided on a radially outer side of a loop to be formed on the wire feeding path by the wire curled by the curl guide.

4. The binding machine according to claim 1, wherein the retraction guide part is provided at a tip end of the curl guide with respect to the feeding direction of the wire that is fed by the wire feeding unit in the direction of curling the wire by the curl guide.

5. The binding machine according to claim 1, wherein the retraction guide part is configured to retract the wire to an outside of the curl guide.

6. A binding machine comprising:

a wire feeding unit configured to feed, on a wire feeding path, a wire to be wound on an object to be bound;

a binding unit configured to twist the wire wound on the object to be bound;

a curl guide configured to curl, on the wire feeding path, the wire being fed by the wire feeding unit, the curl guide including (i) a guide plate located at a center of the curl guide and (ii) a guide groove, the guide plate including a concave part that is widened with respect to the guide groove;

an inductive guide configured to guide, on the wire feeding path, the wire curled by the curl guide toward the binding unit; and a retraction guide part configured to retract the wire to a position (i) that is downstream of the binding unit and (ii) in a direction offset from a feeding direction of the wire that is fed by the wire feeding unit, wherein the retraction guide part corresponds to the concave part of the guide plate, wherein the retraction guide part is located on the binding machine at a position that is external to the wire feeding path.

7. The binding machine according to claim 6, wherein the retraction guide part is provided on an axially outer side of a loop to be formed on the wire feeding path by the wire curled by the curl guide.

8. A binding machine comprising:

a wire feeding unit configured to feed, on a wire feeding path, a wire to be wound on an object to be bound;

a binding unit configured to twist the wire wound on the object to be bound;

a curl guide configured to curl, on the wire feeding path, the wire being fed by the wire feeding unit, the curl guide including (i) a guide plate located at a center of the curl guide, and (ii) a guide groove;

an inductive guide configured to guide, on the wire feeding path, the wire curled by the curl guide toward the binding unit; and a retraction guide part configured to retract the wire to a position that is (i) downstream of the binding unit and (ii) in a direction offset from a feeding direction of the wire that is fed by the wire feeding unit, wherein the retraction guide part corresponds to a hole portion that extends from the guide groove through the guide plate, wherein the retraction guide part is located on the binding machine at a position that is external to the wire feeding path.

* * * * *